US012808573B2

(12) United States Patent
Sohn et al.

(10) Patent No.: US 12,808,573 B2
(45) Date of Patent: Nov. 24, 2026

(54) AIR CONDITIONER

(71) Applicant: LG ELECTRONICS INC., Seoul (KR)

(72) Inventors: Youngwook Sohn, Seoul (KR); Yongnam Kim, Seoul (KR); Taeyun Lee, Seoul (KR); Ilha Park, Seoul (KR); Taewoo Yoo, Seoul (KR); Hyewon Kim, Seoul (KR); Sehwan Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 464 days.

(21) Appl. No.: 18/374,105

(22) Filed: Sep. 28, 2023

(65) Prior Publication Data

US 2024/0117990 A1 Apr. 11, 2024

(30) Foreign Application Priority Data

Oct. 7, 2022 (KR) ..... 10-2022-0128431

(51) Int. Cl.
*F24F 13/14* (2006.01)

(52) U.S. Cl.
CPC ..... *F24F 13/1413* (2013.01); *F24F 13/1426* (2013.01); *F24F 2013/1433* (2013.01);
(Continued)

(58) Field of Classification Search
CPC ..... F24F 13/1413; F24F 13/1426; F24F 2013/1433; F24F 2013/1446;
(Continued)

(56) References Cited

U.S. PATENT DOCUMENTS 10,746,456 B2 8/2020 Kim et al.
2009/0098820 A1* 4/2009 Yabu ..... F24F 13/072 454/333

(Continued)

FOREIGN PATENT DOCUMENTS

CN 101231025 7/2008
CN 101231025 A * 7/2008 ..... F24F 11/65

(Continued)

OTHER PUBLICATIONS

English translation of CN-101231025-A, dated Jan. 5, 2026 (Year: 2026).*

(Continued)

*Primary Examiner* — Michael G Hoang
*Assistant Examiner* — Brett P. Mallon
(74) *Attorney, Agent, or Firm* — KED & ASSOCIATES

(57) ABSTRACT

The air conditioner according to an embodiment of the present disclosure includes: a base panel having a first communication hole formed in one side thereof, and a second communication hole formed in another side thereof; a variable panel disposed under the base panel and changed in shape to open and close the first communication hole and the second communication hole; and a driving device disposed on an upper side of the base panel and changing a position of one side of the variable panel in an up-down direction, so that the variable panel is changed in shape.

21 Claims, 26 Drawing Sheets

(52) U.S. Cl.
CPC ... *F24F 2013/1446* (2013.01); *F24F 2221/14* (2013.01); *F24F 2221/17* (2013.01)

(58) Field of Classification Search
CPC .... F24F 2221/14; F24F 2221/17; F24F 13/10; F24F 13/06
See application file for complete search history.

(56) References Cited

U.S. PATENT DOCUMENTS

| | | | | |
|---|---|---|---|---|
| 2017/0067681 | A1* | 3/2017 | Kim | F24F 1/0047 |
| 2018/0008924 | A1* | 1/2018 | Park | B01D 46/0047 |

FOREIGN PATENT DOCUMENTS

| | | | | |
|---|---|---|---|---|
| CN | 106247592 | A * | 12/2016 | F24F 13/1426 |
| EP | 2208942 | A2 * | 7/2010 | F24F 11/52 |
| EP | 2208943 | A1 * | 7/2010 | F24F 1/0014 |
| EP | 2208943 | | 3/2018 | |
| EP | 3730845 | | 10/2020 | |
| EP | 3730845 | A1 * | 10/2020 | F24F 13/28 |
| KR | 10-2401787 | | 5/2022 | |

OTHER PUBLICATIONS

English translation of CN-106247592-A, dated Jan. 5, 2026 (Year: 2026).*
Extended European Search Report dated Feb. 12, 2024 issued in Application No. 23201105.6.

* cited by examiner

AIR CONDITIONER

CROSS-REFERENCE TO RELATED PATENT APPLICATIONS

This application claims priority to Korean Patent Application No. 10-2022-0128431, filed Oct. 7, 2022, whose entire disclosures are hereby incorporated by reference.

BACKGROUND OF THE INVENTION

1. Field of the Invention

The present disclosure relates to an air conditioner, and more particularly to an air conditioner mounted on the ceiling or on one side of the wall.

2. Description of the Related Art

An air conditioner is mounted on the ceiling or wall with its inlet and outlet being exposed to the outside. In addition, a grille is disposed at a portion where the inlet is formed, and a vane is disposed at a portion where the outlet is formed. These structures are exposed to the outside, spoiling the aesthetics of the indoor space.

Korean Patent No. KR 10-2401787 B1 discloses an air conditioner having an inlet and an outlet that are exposed to the outside. In the air conditioner, an inlet grille is disposed in a region where the inlet is formed, resulting in a complicated structure, and a vane is disposed in a region where the outlet is formed, such that the air conditioner has multiple structures that are partially exposed to the outside.

The inlet and the outlet are provided for generating an airflow, but unlike a wall surface or a ceiling surface that is formed flat, the inlet and the outlet are formed with multiple structures and shapes, and thus are inharmonious with the wall surface or the ceiling surface, spoiling the aesthetics in terms of unity. In addition, there is also a problem in that as the inlet or the outlet is exposed to the outside, foreign matter may be introduced into the air conditioner from the outside.

SUMMARY OF THE INVENTION

In accordance with an aspect of the present disclosure, the above and other objectives can be accomplished by providing an air conditioner including a base panel having a first communication hole formed in one side thereof, and a second communication hole formed in another side thereof. The air conditioner includes a variable panel disposed under the base panel and changed in shape to open and close the first communication hole and the second communication hole. The air conditioner includes a driving device disposed on an upper side of the base panel and changing a position of one side of the variable panel in an up-down direction, so that the variable panel is changed in shape. The variable panel may cover a lower side of the base panel or may open the communication holes formed in the base panel.

The driving device may include a first driving device configured to change a shape of the variable panel. The driving device may include a second driving device configured to move a position of the variable panel. Accordingly, the driving device may change the shape of the variable panel or may move the position of the variable panel.

The variable panel may include a cover part disposed at a lower side of the first communication hole or the second communication hole, and a variable part changing an inclination angle of the cover part. By the operation of the driving device, the variable part is changed in shape or structure, such that a position of the cover part may be changed.

The driving device may include a first motor fixed to the base panel, and configured to change the shape of the variable panel or to move the position of the variable panel. Accordingly, by using a single motor, the shape of the variable panel may by changed or the position thereof may be moved.

The variable panel may include a fixed part disposed between the first communication hole and the second communication hole and fixed in position vertically relative to the base panel, and a cover part disposed on one side of the fixed part and changed in position vertically relative to the base panel, wherein the first motor may be configured to change an inclination angle of the cover part or to move a position of the cover part.

The variable panel may include a first plate disposed at a lower side of the first communication hole. The variable panel may include a second plate disposed at a lower side of the second communication hole. The driving device may include a second motor configured to change an inclination angle of the second plate. The first motor may be configured to change an inclination angle of the first plate or to move a position of the first plate.

The driving device may include a first gear connected to the first motor to be rotated thereby. The driving device may include a second gear connected to the second motor to be rotated thereby. The driving device may include a first panel moving plate connected to the first plate and changing an inclination angle of the first plate by the rotation of the first gear. The driving device may include a second panel moving plate connected to the second plate and changing an inclination angle of the second plate by the rotation of the second gear. The variable panel may be changed in position by the first panel moving plate and the second panel moving plate.

The driving device may further include a spacer maintaining a distance between the first panel moving plate and the second panel moving plate, thereby increasing a curvature of the variable part that is changed in shape.

A panel guider, guiding movement of each of a first panel guide and a second panel guide, may be disposed on the base panel, thereby guiding a change in shape or position of the variable panel.

A first guide pin, extending around a first rotating shaft of the first panel moving plate, may be disposed on the first panel moving plate. A second guide pin, extending around a second rotating shaft of the second panel moving plate, may be disposed on the second panel moving plate. A first guide hole and a second guide hole may be formed in the panel guider, the first guide hole guiding movement of the first guide pin, and the second guide hole guiding movement of the second guide pin.

A third guide pin may be disposed on the first panel moving plate, the third guide pin radially spaced apart from the first rotating shaft and extending parallel to the first rotating shaft of the first panel moving plate. A third guide hole, guiding movement of the third guide pin, may be formed in the panel guider.

The third guide hole may include a curved guide hole extending circumferentially from a position spaced apart from the first rotating shaft by a predetermined distance, and a linear guide hole extending from a lower end of the curved guide hole in a direction parallel to the first guide hole. The third guide hole may guide a change of shape and movement of position of the variable panel.

The first panel moving plate may rotate about the first rotating shaft, and a gear surface engaged with the first gear may be formed on one side surface of the first panel moving plate, wherein the gear surface may include a first gear surface formed in a circumferential direction, and a second gear surface connected to one end of the gear surface and extending in a radial direction. Accordingly, in a structure of a single panel moving plate, both the change of shape and movement of position of the variable panel may be provided.

The first gear surface and the second gear surface may be continuously engaged with the first gear, such that a single motor may be continuously engaged with each of the first gear surface and the second gear surface.

A gear surface may be formed on the second panel moving plate, the gear surface radially spaced apart from the second rotation shaft and engaged with the second gear on an outer circumferential surface extending in a circumferential direction. A stopper may be disposed on an upper surface of the second panel moving plate, the stopper limiting downward movement of the second panel moving plate.

A moving panel is disposed under the base panel to be movable forward and backward, and coupled to the variable panel. The first motor may be fixed to one side of the base panel. The second motor may be fixed to an upper side of the moving panel.

The variable panel may include a first plate disposed under the base panel so as to open and close the first communication hole. The variable panel may include a first variable panel comprising a first panel gear connected to the driving device to change a position of the first plate. The variable panel may include a second plate disposed under the base panel so as to open and close the second communication hole. The variable panel may include a second variable panel comprising a second panel gear connected to the driving device to change a position of the second plate. Accordingly, the overall shape of the variable panel may vary depending on the arrangement of the first variable panel and the second variable panel.

The driving device may include a first motor, and a first mover coupled to the first motor so as to move up and down. The driving device may include a first gear coupled to the first mover and changing a position of the first panel gear, and a second gear coupled to the first mover and changing a position of the second panel gear. The arrangement of the first variable panel and the second variable panel may be changed by a single first motor.

The driving device may further include a motor gear connected to a rotating shaft of the first motor. The first gear may be rotated in engagement with the motor gear. The first gear may be engaged with each of the first mover and the first panel gear.

The first gear may include a first inner gear engaged with each of the motor gear and the first mover, and a first outer gear engaged with the first panel gear. The first inner gear and the first outer gear may be rotated together about a same rotation axis. The first gear, rotated around a single rotation axis, may be engaged with two or more components.

The first mover may include a first vertical bar having a first gear surface engaged with the first gear. The first mover may include a second vertical bar spaced apart from the first vertical bar and having a second gear surface engaged with the second gear. The first mover may include a horizontal bar connecting the first vertical bar and the second vertical bar.

The driving device may include a second mover moving the position of the variable panel, and a second motor disposed on the base panel and moving the second mover.

In accordance with another aspect of the present disclosure, air conditioner includes: a base panel having a first communication hole formed in one side thereof, and a second communication hole formed in another side thereof; a variable panel disposed under the base panel and changed in shape to open and close the first communication hole and the second communication hole; and a driving device disposed on the base panel and changing a shape or position of the variable panel. The driving device includes a first driving device configured to change a shape of the variable panel, and a second driving device configured to move a position of the variable panel. Accordingly, the driving device may change the shape of the variable panel or may move the position of the variable panel.

The first driving device may include a first mover mounted on the base panel to be movable up and down, and a first motor configured to move the first mover in an up-down direction. When the first mover moves up and down, the variable panel is changed in shape. The second driving device may include a second mover mounted on the base panel to be movable forward and backward, and a second motor configured to move the second mover in a front-rear direction. A shape of the variable panel may be changed by using the first mover, and a position of the variable panel may be moved by using the second mover.

The first motor may be fixed to the second mover, and the second motor may be fixed to the base panel, such that the first motor may move together with the second mover.

Other detailed matters of the exemplary embodiments are included in the detailed description and the drawings.

Effects of the Invention

An air conditioner according to the present disclosure has one or more of the following effects.

First, a variable panel which is variable in shape in some region is provided, such that when the air conditioner is not in operation, the variable panel may cover both an inlet and an outlet. Accordingly, the inlet and the outlet are closed by the variable panel, thereby minimizing the entry of foreign matter from the outside. In addition, the shape of the variable panel may be changed, such that when the air conditioner is not in operation, the variable panel covers both the inlet and the outlet, with only one panel being exposed to an occupant present in a room, thereby providing a sense of unity with the wall or ceiling.

Second, a driving device changes a shape of the variable panel to open communication holes formed in a base panel, thereby allowing air to flow through the communication holes. Accordingly, the flow of air heat-exchanged or filtered through the communication holes may be secured.

Third, a position of the variable panel may be changed at a lower side of a communication hole through which air is discharged, a flow of the discharged air may be guided.

Fourth, the driving device moves a position of the variable panel, such that an air discharge area may increase in size or air flowing in the discharge area may be guided, thereby allowing air to be discharged to a remote location.

Fifth, a gear surface, formed on a panel moving plate for changing a position of a first plate corresponding to a cover part, extends in various directions, such that by the operation of a single motor, a shape of the first plate may be changed and a position thereof may be moved.

Sixth, a single motor is coupled to two variable panels by a first mover, such that the two variable panels may be changed in shape by using the single motor.

The effects of the present disclosure are not limited to the aforesaid, and other effects not described herein will be clearly understood by those skilled in the art from the following description of the appended claims.

DETAILED DESCRIPTION OF THE PREFERRED EMBODIMENTS

Figure 1:
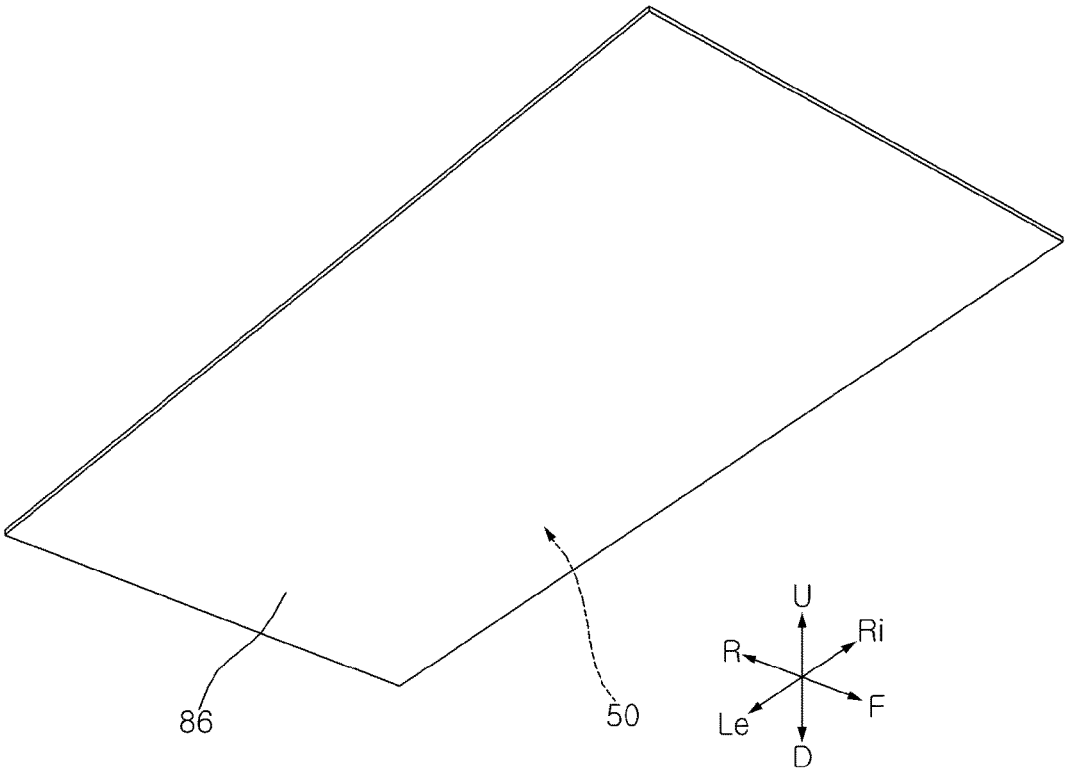
FIG. 1 is a lower perspective view of an air conditioner in which a variable panel of the air conditioner is disposed in a first position, according to a first embodiment of the present disclosure.

Advantages and features of the present disclosure and methods of accomplishing the same may be understood more readily by reference to the following detailed description of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the disclosure to those skilled in the art, and the present disclosure will only be defined by the appended claims. Like reference numerals refer to like elements throughout the specification.

In the specification and the claims, terms such as "first," "second," "third," and the like, if any, will be used to distinguish a plurality of elements from each other, and the use of ordinal terms does not by itself connote any priority, precedence, or order of one element over another.

References to directions, such as up (U), down (D), left (L), right (R), front (F), and rear (R), shown in FIGS. 1 to 42 are merely for convenience of explanation, and not intended for limiting the scope of the present disclosure. Accordingly, the directions may vary depending on a reference direction.

Hereinafter, an air conditioner according to embodiments of the present disclosure will be described with reference to the accompanying drawings.

The air conditioner of the present disclosure may be mounted inside the ceiling or wall. The air conditioner includes a main body (not shown) mounted inside the ceiling or wall and defining a space, a base panel 10 disposed on one side of the body and having a first communication hole 12 and a second communication hole 14, a variable panel 50 disposed on one side of the base panel 10 and changed in shape to cover or open the first communication hole 12 and the second communication hole 14, and a driving device 100 configured to change a shape or position of the variable panel 50 based on the base panel 10.

Here, one of the first communication hole 12 and the second communication hole 14 may be an inlet through which outside air is drawn into the air conditioner. The other one of the first communication hole 12 and the second communication hole 14 may be an outlet through which air in the air conditioner is discharged to the outside.

A fan (not shown) for generating an air flow, a motor (not shown) for rotating the fan, a heat exchanger (not shown) for heat exchanging air discharged through the second communication hole 14, a drain pan (not shown) for collecting and discharging condensate generated in the heat exchanger, and the like may be mounted in the main body.

Hereinafter, with reference to FIGS. 1 to 22, the base panel 10, the variable panel 50, and the driving device 100 will be described using an example of an air conditioner mounted on the ceiling. However, the structure of the base panel 10, the variable panel 50, and the driving device 100 which will be described below may also be applied to an air conditioner mounted on the wall, etc., in addition to the air conditioner mounted on the ceiling.

Referring to FIG. 1, the variable panel 50 is disposed under the base panel 10 to cover the main body (not shown) and a lower portion of the base panel 10. Here, the position to cover the lower portion may include a position at which the main body or the base panel 10 may be covered when viewed from below.

Figure 2:
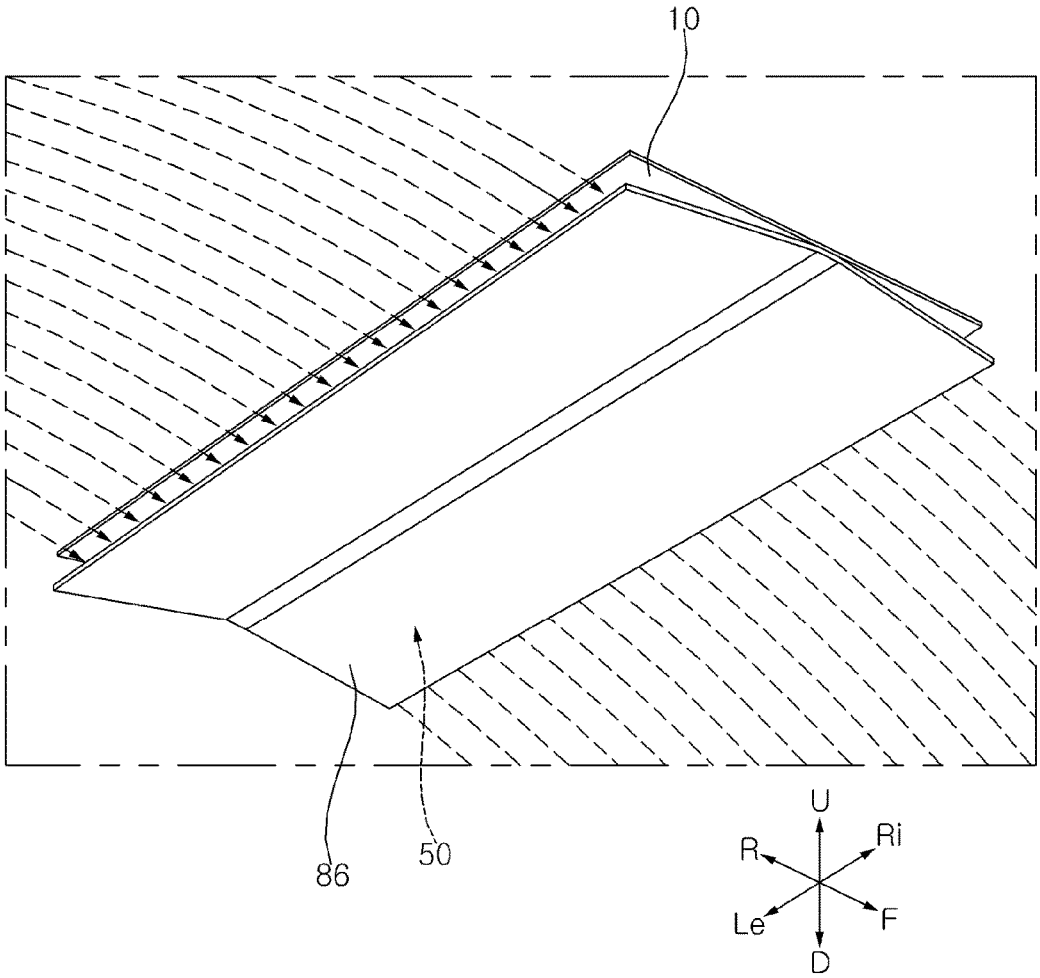
FIG. 2 is a lower perspective view of an air conditioner in which a variable panel of the air conditioner is disposed in a second position, according to the first embodiment of the present disclosure.

Referring to FIG. 2, the variable panel 50 may be changed in shape to open the first communication hole 12 and the second communication hole 14 which are formed in the base panel 10.

The variable panel 50 may allow the first communication hole 12 and the second communication hole 14 to open and close simultaneously or together. Here, the opening and closing simultaneously may refer to opening and closing together at the same time. Here, the opening and closing together may refer to opening and closing together through a single operation and does not mean opening and closing at the same time in a temporal sense.

The variable panel 50 may individually open and close the first communication hole 12 and the second communication hole 14. The variable panel 50 is made of heterogeneous materials, such that some region may be easily bent. The variable panel 50, including a silicone material and the like in some region thereof, may be changed in shape. Further, the variable panel 50 has a structure in which a plurality of panels are connected, and connecting portions of the plurality of panels are rotated.

The variable panel 50 may be mounted on the base panel 10 in a region between the first communication hole 12 and the second communication hole 14. The variable panel 50 may be mounted on the base panel 10 so as to be movable forward and backward. That is, the variable panel 50 may be mounted on the base panel 10 to be movable in a region between the first communication hole 12 and the second communication hole 14.

Figure 3:
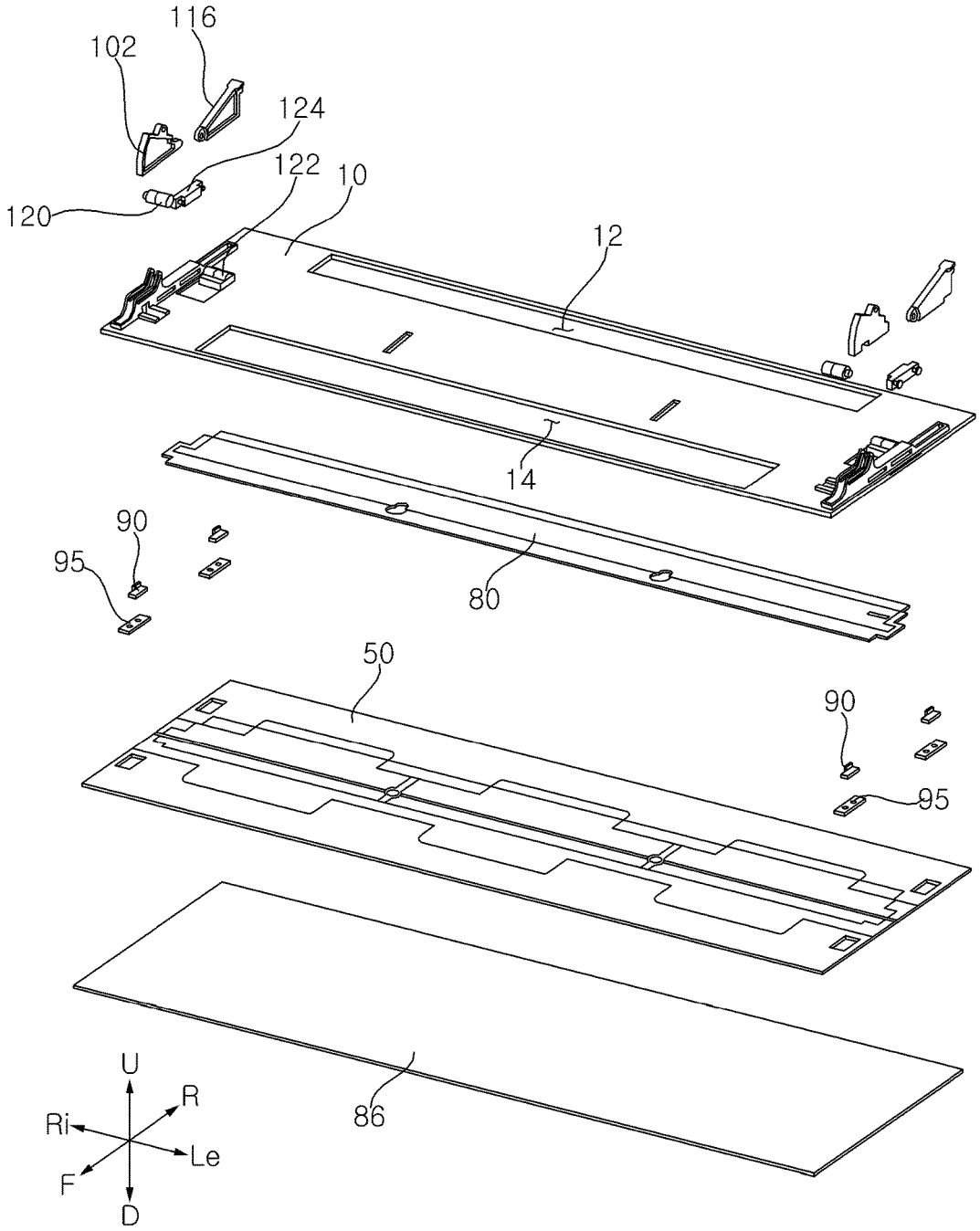
FIG. 3 is an exploded perspective view of a base, a variable panel, and a driving device of the air conditioner according to the first embodiment of the present disclosure.

Referring to FIG. 3, the air conditioner includes the base panel 10 having the first communication hole 12 and the second communication hole 14, the variable panel 50 disposed on one side of the base panel 10 and changed in shape to be bent or flat in some region, and the driving device 100 mounted to the base panel 10 and changing a shape of the variable panel 50.

Figure 4:
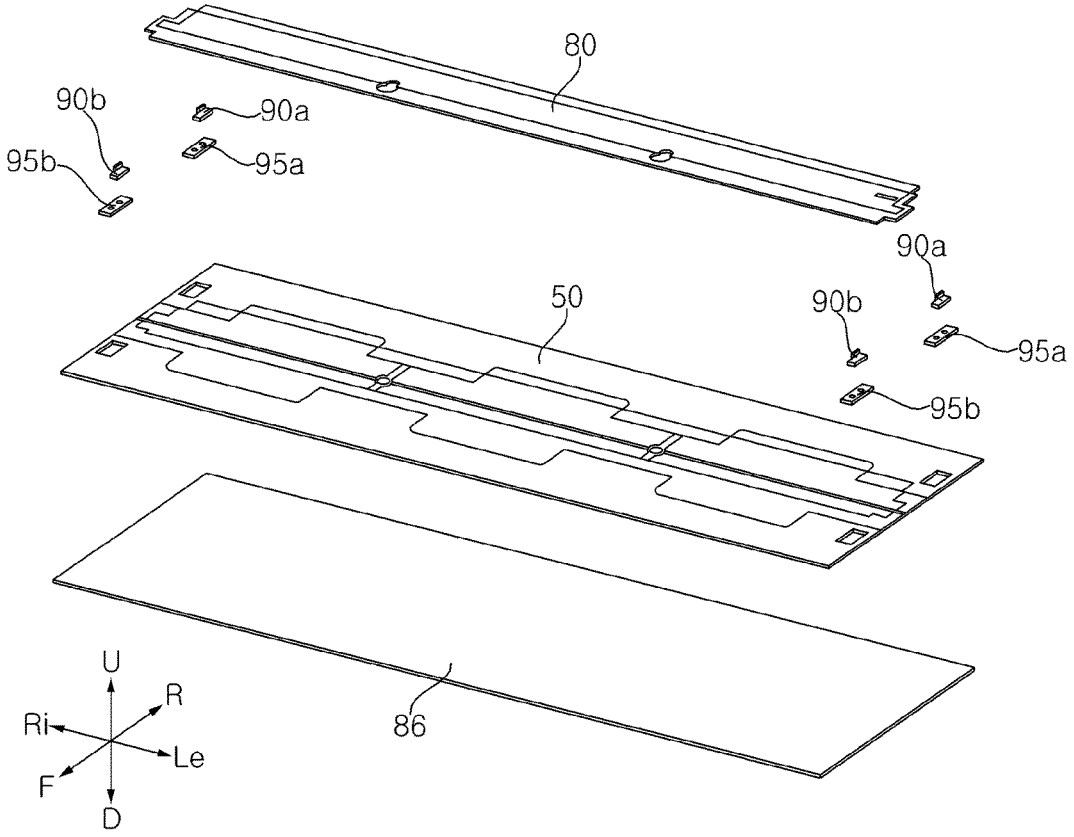
FIG. 4 is an exploded perspective view of a variable panel, a cover panel, and a moving panel of the air conditioner according to the first embodiment of the present disclosure.

Referring to FIG. 4, the air conditioner includes a moving panel 80 disposed under the base panel 10 and coupled to the variable panel 50, a cover panel 86 disposed under the variable panel 50 to cover a lower surface of the variable panel 50, a bracket 90 movably mounted to the variable panel 50 and coupled to the driving device 100, and a bracket guider 95 mounted to the variable panel 50 and guiding movement of the bracket 90.

The variable panel 50 is disposed under the base panel 10. The variable panel 50 may be mounted to the base panel 10 from the bottom of the base panel 10. Here, a method of mounting the variable panel 50 to the base panel 10 may include direct connection of the variable panel 50 to the base panel 10. In addition, a method of mounting the variable panel 50 to the base panel 10 may include indirect connection of the variable panel 50 to the base panel 10 via the moving panel 80 or the driving device 100.

In this embodiment, the variable panel 50 may be indirectly mounted to the base panel 10 via the driving device 100.

The moving panel 80 may fix the position of a central portion of the variable panel 50. The variable panel 50 may have a bent portion which may partially sag due to gravity. The moving panel 80 may fix the position of the variable panel 50 in a region where the variable panel 50 is bent, thereby preventing the variable panel 50 from partially drooping or sagging.

Hereinafter, a configuration of the moving panel 80 and a coupling relationship between the moving panel 80 and the variable panel 50 will be described in detail.

The cover panel 86 is disposed under the variable panel 50. The cover panel 86 may be adhered to a lower surface of the variable panel 50. The cover panel 86 may also be connected to the variable panel 50 by a separate fastening member (not shown).

The cover panel 86 may be formed in a size enough to cover the lower surface of the variable panel 50. The cover panel 86 may be formed in a size enough to cover the lower surface and a peripheral surface of the variable panel 50.

Variable Panel>

The variable panel 50 may include a fixed part which is disposed between the first communication hole 12 and the second communication hole 14, and which is fixed in position vertically relative to the base panel 10, a cover part spaced apart from the fixed part and disposed at a lower side of the first communication hole 12 or the second communication hole 14, and a variable part disposed between the fixed part and the cover part and changing an inclination angle of the cover part.

Here, the fixed part may be a central rib 62 which will be described below. The cover part may be a rigid body 52 which will be described later. The cover part may be a first plate 54*a* and a second plate 54*b* which will be described below. The variable part may be a flexible body 70 which will be described below. Accordingly, the variable part may be made of a deformable material. The variable part may be made of a different material from the cover part.

The variable panel 50 includes the rigid body 52 made of a rigid material and having a bending hole 68 formed in some region, and the flexible body 70 made of a flexible material and disposed in the bending hole 68 formed in the rigid body 52.

The rigid body 52 may be disposed in a front-rear direction with respect to the flexible body 70. The rigid body 52 includes the first plate 54*a* disposed on one side of the flexible body 70, the second plate 54*b* disposed on another side of the flexible body 70, a bridge 66 connecting the first plate 54*a* and the second plate 54*b*, and the central rib 62 disposed between the first plate 54*a* and the second plate 54*b*.

The rigid body 52 may further include a fixed hook 64 fixed to the base panel 10 or the moving panel 80 to prevent the central portion of the variable panel 50 from sagging.

Figure 6:
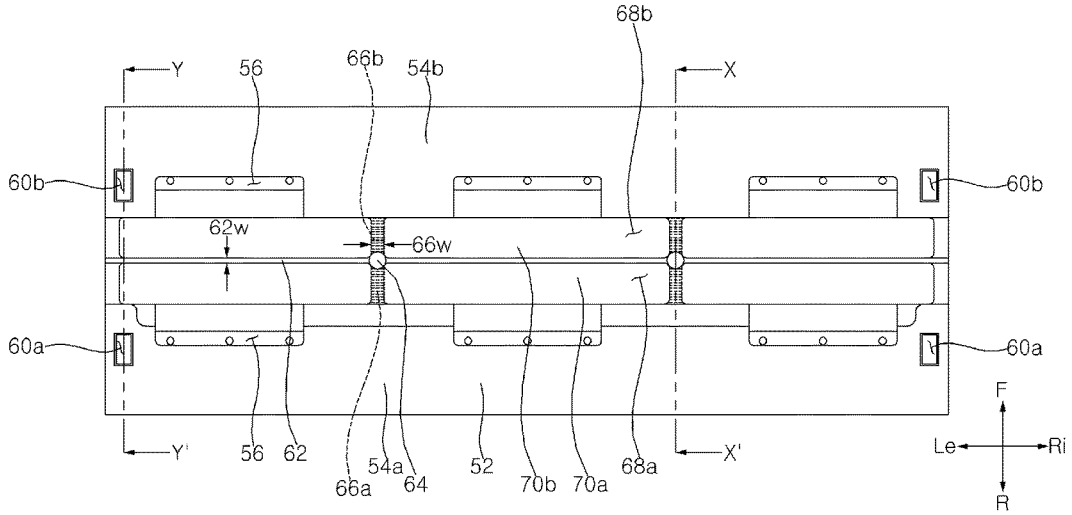
FIG. 6 is a plan view of the variable panel according to the first embodiment of the present disclosure.

The rigid body 52 has a first bending hole 68*a* formed in one of the front and rear sides of the central rib 62, and a second bending hole 68*b* formed in the other one of the front and rear sides of the central rib 62. The first bending hole 68*a* and the second bending hole 68*b* may be divided by the bridge 66 into a plurality of regions. Referring to FIG. 6, the first bending hole 68*a* may be formed in the rear side of the central rib 62, and the second bending hole 68*b* may be formed in the front side of the central rib 62.

The flexible body 70 may be disposed in each of the first bending hole 68*a* and the second bending hole 68*b*. The flexible body 70 may be made of a deformable material. The flexible body 70 may be made of a silicone or rubber material. The flexible body 70 may be molded into the bending hole 68 formed in the rigid body 52. The flexible body 70 may be injection molded into the bending hole 68 formed in the rigid body 52.

In order to prevent the flexible body 70, disposed in the first bending hole 68*a* and the second bending hole 68*b*, from being separated from the rigid body 52, grooves 56 and 58 extending from the bending hole 68 in the front-rear direction are formed in the rigid body 52.

Figure 5:
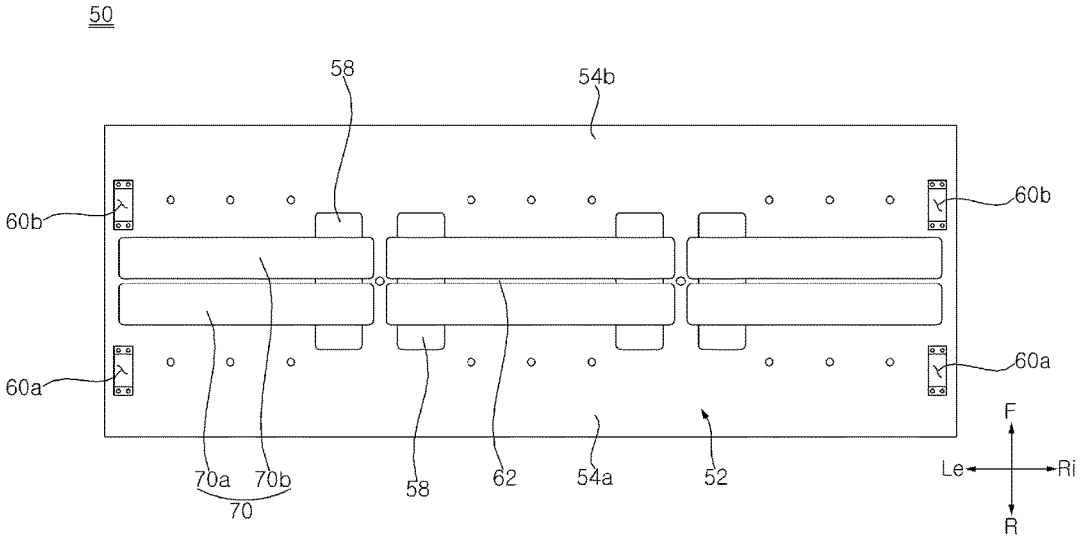
FIG. 5 is a bottom view of the variable panel according to the first embodiment of the present disclosure.

The grooves 56 and 58, fixing the position of the flexible body 70 disposed in the bending hole 68, are formed in the rigid body 52. The grooves 56 and 58 are formed in a lower surface 52*b* and an upper surface 52*a*, respectively, of the rigid body 52. The grooves 56 and 58 includes an upper groove 56 formed in the upper surface 52*a* of the rigid body 52, and a lower groove 58 formed in the lower surface 52*b* of the rigid body 52. Referring to FIGS. 5 and 6, an area of the lower groove 58 is smaller than an area of the upper groove 56.

The upper groove 56 and the lower groove 58 may be formed at positions spaced apart in a left-right direction.

A bracket hole 60, in which the bracket 90 or the bracket guider 95 is mounted, may be formed in the rigid body 52. The bracket hole 60 is formed in each of the first plate 54*a* and the second plate 54*b*. The bracket hole 60 includes a first bracket hole 60*a*, formed in the first plate 54*a*, and a second bracket hole 60*b* formed in the second plate 54*b*. Referring to FIG. 3, the first plate 54*a* is disposed at a lower side of the first communication hole 12 of the base panel 10, and the second plate 54*b* is disposed at a lower side of the second communication hole 14 of the base panel 10.

The first bracket hole 60*a* is formed in the first plate 54*a* at each of both ends thereof in a horizontal or left-right direction. The second bracket hole 60*b* is formed in the second plate 54*b* at each of both ends thereof in the horizontal direction. Each of the first bracket hole 60*a* and the second bracket hole 60*b* may be located further outward than the upper groove 56 or the lower groove 58. Here, the outward direction may be a direction close to the edge of the rigid body 52 in the horizontal direction.

The central rib 62 is disposed between the first plate 54*a* and the second plate 54*b*. The central rib 62 may be disposed on each of the first plate 54*a* and the second plate 54*b* at positions spaced apart from each other. The central rib 62 is disposed between the first bending hole 68*a* and the second bending hole 68*b*. The flexible body 70 includes a first flexible body 70*a* disposed in the first bending hole 68*a*, and a second flexible body 70*b* disposed in the second bending hole 68*b*.

The central rib 62 is disposed between the first flexible body 70*a* and the second flexible body 70*b*. The central rib 62 is fixed to the base panel 10 or the moving panel 80.

The variable panel 50 may be fixed to the moving panel 80. A position of the variation panel 50 may be changed according to a change in position of the moving panel 80. Accordingly, the arrangement of the first plate 54*a* and the second plate 52*b* may be changed, which are disposed at the front and rear side of the central rib 62 of the variable panel 50. The central rib 62 may be spaced an equal vertical distance from the base panel 10. In addition, if the central rib 62 is directly connected to the base panel 10, the central rib 62 is fixed to the base panel 10, and thus remains in position.

Accordingly, if the flexible body 70 disposed at the front and rear side of the central rib 62 is changed in shape, the arrangement of the first plate 54*a* and the second plate 54*b* may be changed. If the flexible body 70 disposed at the front and rear side of the central rib 62 is changed in shape, an inclination angle of the first plate 54*a* and the second plate 54*b* may be changed. Here, the inclination angle may refer to an angle formed between a plane parallel to the ground surface or a ceiling surface, and a surface formed by the first plate 54*a* or the second plate 54*b*.

The fixed hook 64 may be formed on the central rib 62. The fixed hook 64, protruding upward from the central rib 62, allows the variable panel 50 to be mounted to the moving panel 80 or the base panel 10. In this embodiment, the fixed hook 64 is inserted into a hook hole 82 formed in the moving panel 80. The fixed hook 64 may fix the variable panel 50 to the moving panel 80. Accordingly, as the fixed hook 64 is inserted into the hook hole 82 of the moving panel 80, the variable panel 50 may move along with the movement of the moving panel 80.

A plurality of fixed hooks 64, which are spaced apart from each other in the horizontal direction, may be disposed on the variable panel 50. Referring to FIG. 6, the fixed hooks 64 may be disposed in a region in which the bridge 66 and the central rib 62 intersect each other.

Figure 7:
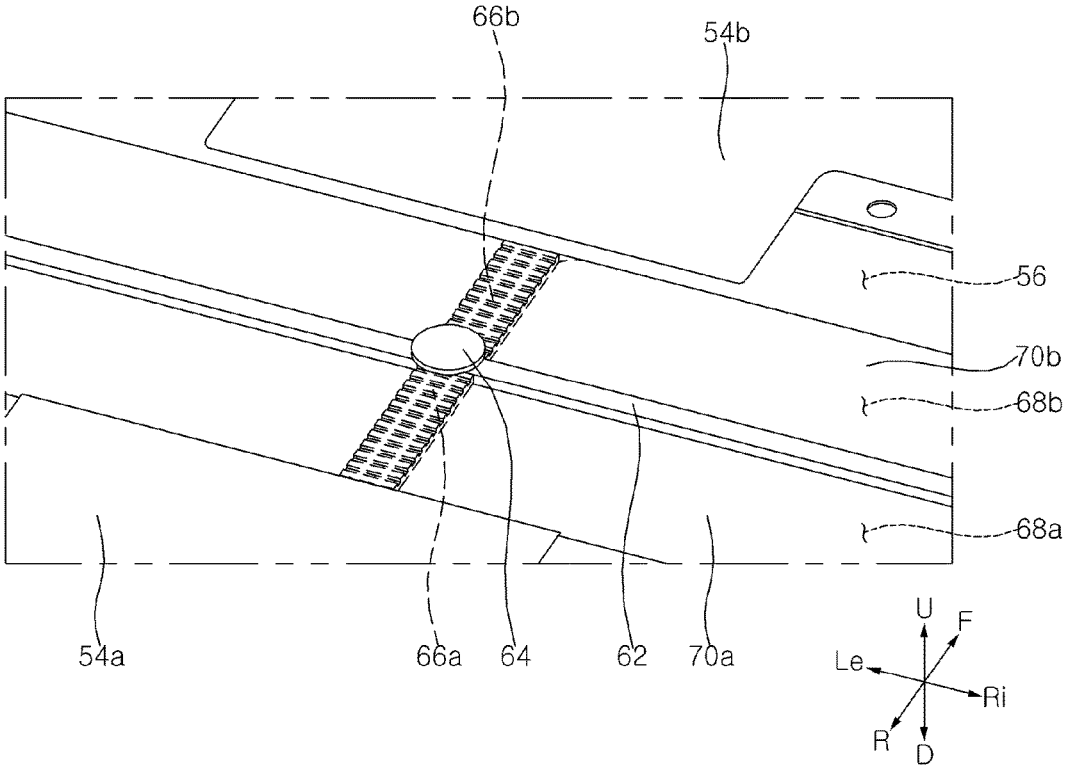
FIG. 7 is a diagram explaining a bridge according to the first embodiment of the present disclosure.
Figure 8A:
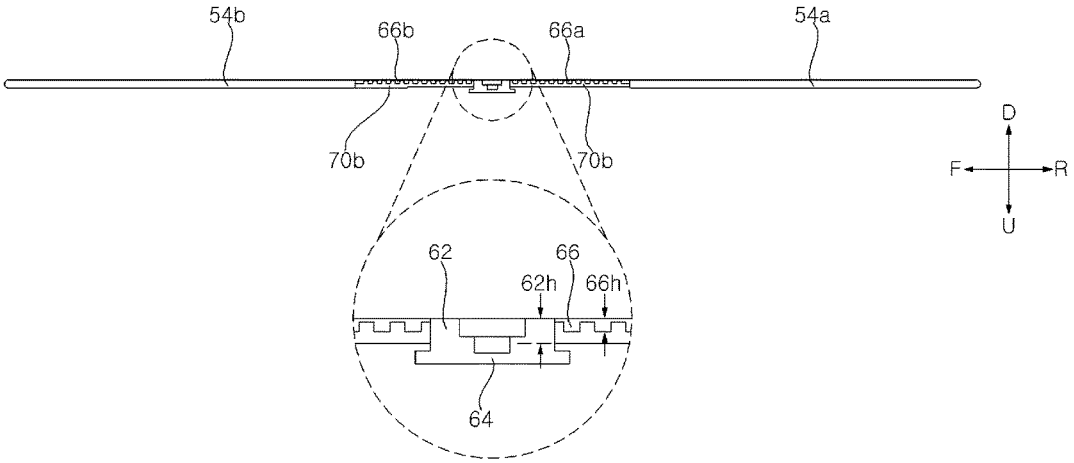
FIG. 8A is a cross-sectional view taken along line X-X' of FIG. 6.
Figure 8B:
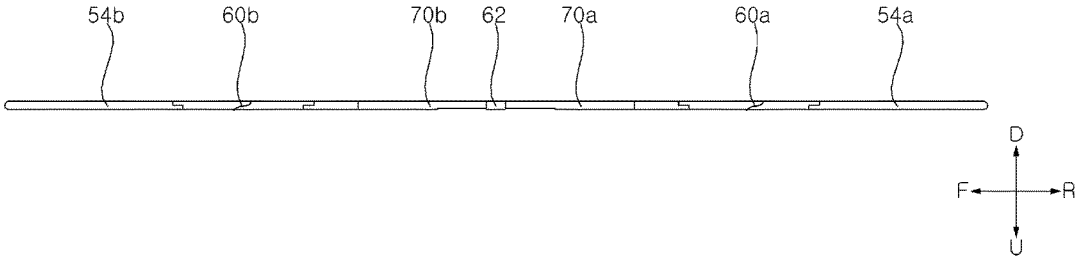
FIG. 8B is a cross-sectional view taken along line Y-Y' of FIG. 6.

Referring to FIG. 7, the fixed hook 64 protrudes in a cylindrical shape upward from the central rib 62 and has an upper end protruding radially outwardly, to be mounted in the hook hole 82 of the moving panel 80.

Referring to FIG. 6, a plurality of bridges 66 are disposed on the variable panel 50. The respective bridges 66 are spaced apart from each other in the horizontal direction. The bridges 66 are disposed in a region in which the flexible body 70 is disposed. The bridges 66 connect each of the central rib 62, the first plate 54*a*, and the second plate 54*b*, thereby stably maintaining a bending range or shape of the flexible body 70.

The respective bridges 66 may connect the first plate 54*a* and the second plate 54*b*. The respective bridges 66 connect the first plate 54*a* and the central rib 62. The respective bridges 66 connect the second plate 54*b* and the central rib 62.

The bridges 66 may include a first bridge 66*a* connecting the first plate 54*a* and the central rib 62, and a second bridge 66*b* connecting the second plate 54*b* and the central rib 62.

A vertical height 66*h* of the bridge 66 is less than a vertical height 62*h* of the central rib 62. Accordingly, the flexible body 70 comes into contact with an upper surface of the bridge 66. A width 66*w* (from left to right) of the bridge 66 is greater than a width 62*w* (from front to rear) of the central rib 62.

A lower surface of the bridge 66 may be formed as a flat surface so as to be smoothly connected to the first plate 54*a* and the second plate 54*b*. An upper surface of the bridge 66 may have a serration shape.

The upper surface of the bridge 66, which has a serration shape, may alleviate a problem in that the bridge 66 is separated from the flexible body 70 at a contact portion with the flexible body 70. In addition, the upper surface of the bridge 66 has a serration shape, such that even when the variable panel 50 is changed in shape, the bridge 66 is prevented from being deformed by elongation or compression of the variable panel 50 or the cover panel 86.

Moving Panel>

The moving panel 80 fixes the position of the central rib 62 of the variable panel 50. That is, the moving panel 80 may allow the central rib 62, disposed at the center of the variable panel 50, to remain fixed in position vertically relative to the base panel 10. Here, if the central rib 62 is vertically spaced apart from the base panel 10, positions of the central rib 62 and the base panel 10, which are vertically relative to each other, may refer to positions spaced apart from each other. Further, if the central rib 62 is disposed in contact with the base panel 10, positions of the central rib 62 and the base panel 10 may refer to positions at which the central rib 62 and the base panel 10 may remain in contact with each other.

The moving panel 80 may fix the position of the central rib 62, thereby preventing the central rib 62 from relatively sagging in the variable panel 50. The central rib 62, disposed between the first flexible body 70*a* and the second flexible body 70*b*, moves relative thereto, such that sagging may occur. As the moving panel 80 fixes the position of the central rib 62, the first flexible body 70*a* and the second flexible body 70*b*, which are disposed on both sides of the centra rib 62, may be bent downward.

The moving panel 80 may be made of a material having rigidity, thereby preventing the central rib 62 form sagging downward in the variable panel 50.

Figure 9:
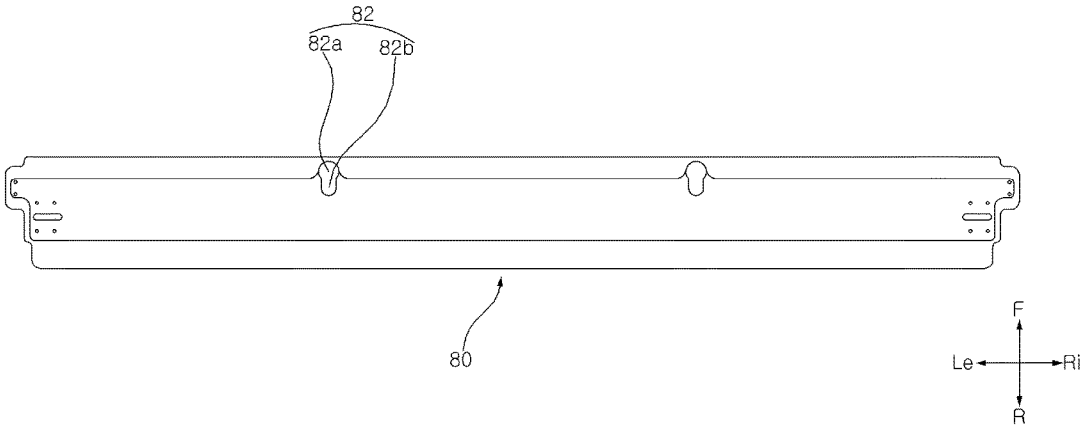
FIG. 9 is a plan view of a moving panel according to the first embodiment of the present disclosure.
Figure 10:
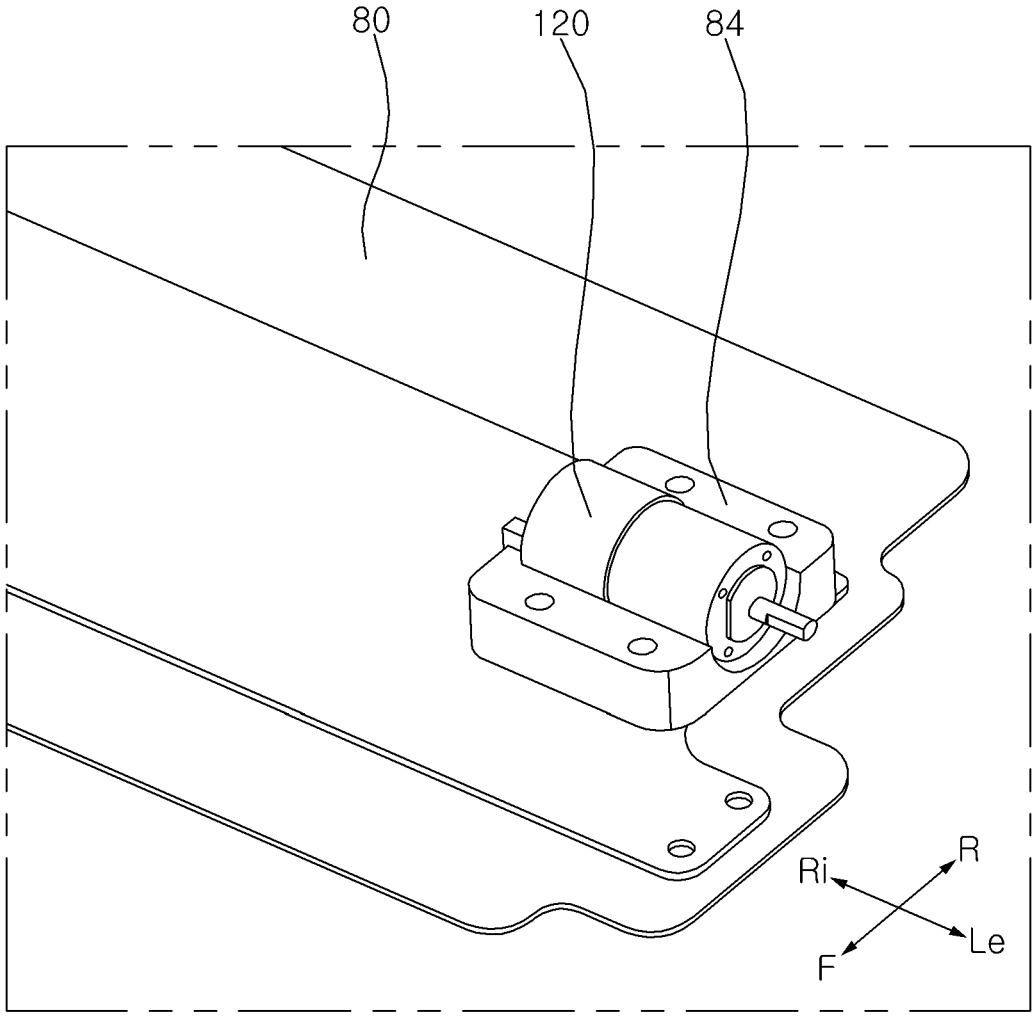
FIG. 10 is a diagram explaining one end of the moving panel and a motor disposed on an upper side thereof, according to the first embodiment of the present disclosure.
Figure 11:
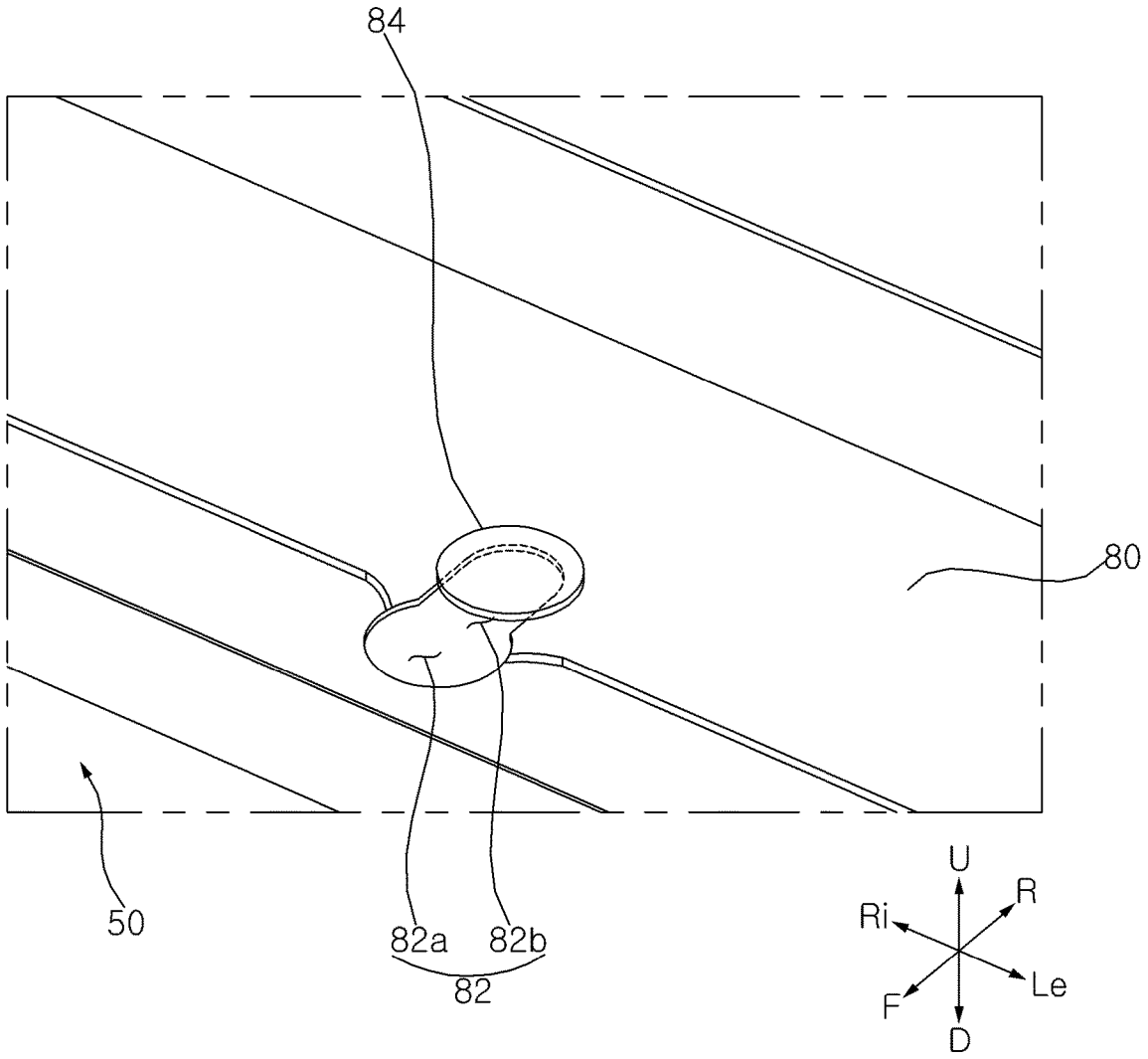
FIG. 11 is a diagram explaining a coupling relationship between the moving panel land the variable panel according to the first embodiment of the present disclosure.
Figure 12:
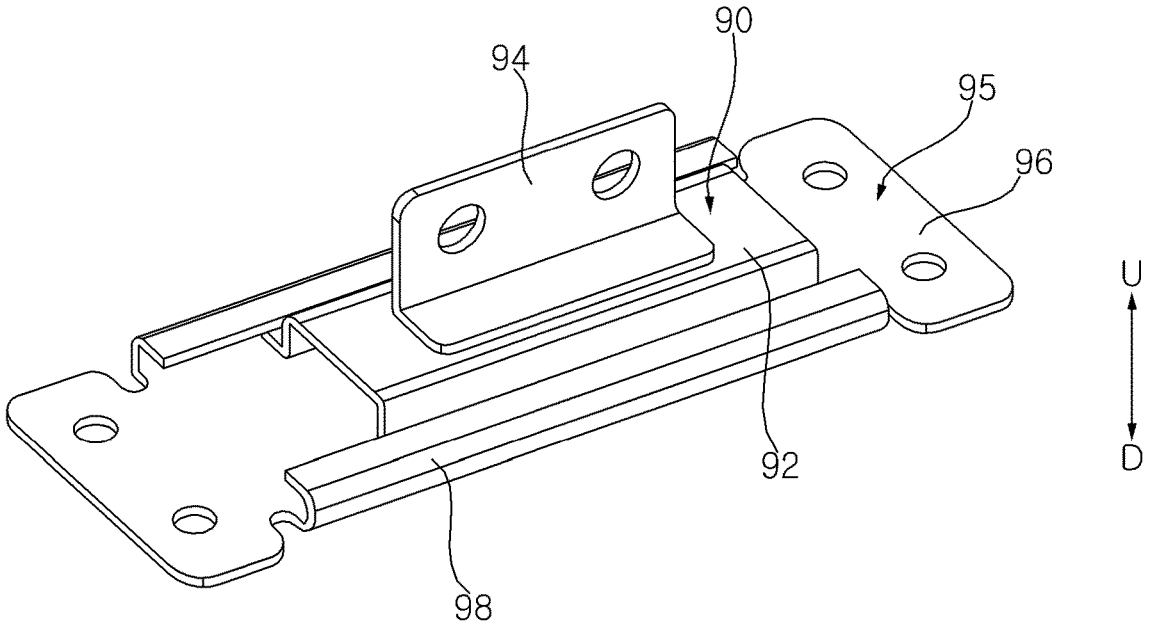
FIG. 12 is a perspective view of a state in which a bracket and a bracket guider are coupled to each other, according to the first embodiment of the present disclosure.

Referring to FIG. 9, the moving panel 80 has the hook hole 82 into which the fixed hook 64 of the variable panel 80 is inserted and mounted. The hook hole 82 includes an insertion hole 82*a*, into which the fixed hook 64 is inserted, and a fixing hole 82*b* in which the fixed hook 64 is mounted. The insertion hole 82*a* is formed to be greater than a diameter of an upper end of the fixed hook 64, and the fixing hole 82*b* is formed to be smaller than the diameter of the upper end of the fixed hook 64. Referring to FIG. 11, while being inserted into the fixing hole 82*b* of the hook hole 82, the fixed hook 64 may be fixed to the moving panel 80.

The central rib 62 is fixed to the moving panel 80, such that if the moving panel 80 moves forward and backward, the variable panel 50 as a whole may also move forward and backward.

The moving panel 80 is elongated in a forward direction in which the second communication hole 14 is formed, rather than in a rearward direction in which the first communication hole 12 is formed, with respect to the hook hole 82.

A second motor mounter 84, on which a second motor 122 of the driving device 100 to be described later is mounted, is disposed at both ends in the left-right direction of the moving panel 80. Accordingly, the second motor mounter 84 and the second motor 122 may move forward and backward together with the moving panel 80.

Bracket and Bracket Guider>

A plurality of brackets 90 and a plurality of bracket guiders 95 are disposed on the variable panel 50. Each of the plurality of brackets 90 may be disposed in each of the plurality of bracket guiders 95.

Referring to FIG. 4, each of the plurality of brackets 90 and each of the plurality of bracket guider 95 may be disposed in two first bracket holes 60*a*, formed in the first plate 54*a*, and two second bracket holes 60*b* formed in the second plate 54*b*.

The bracket 90 includes a first bracket 90*a* disposed in the first bracket hole 60*a*, and a second bracket 90*b* disposed in the second bracket hole 60*b*. The bracket guider 95 includes a first bracket guider 95*a* in which the first bracket 90*a* is disposed, and a second bracket guider 95*b* in which the second bracket 90*b* is disposed.

The bracket guider 95 is fixed to the variable panel 50. The bracket guider 95 is disposed in the bracket hole 60 of the variable panel 50. The bracket 90 is disposed in the bracket guider 95 to be movable forward and backward.

Figure 13:
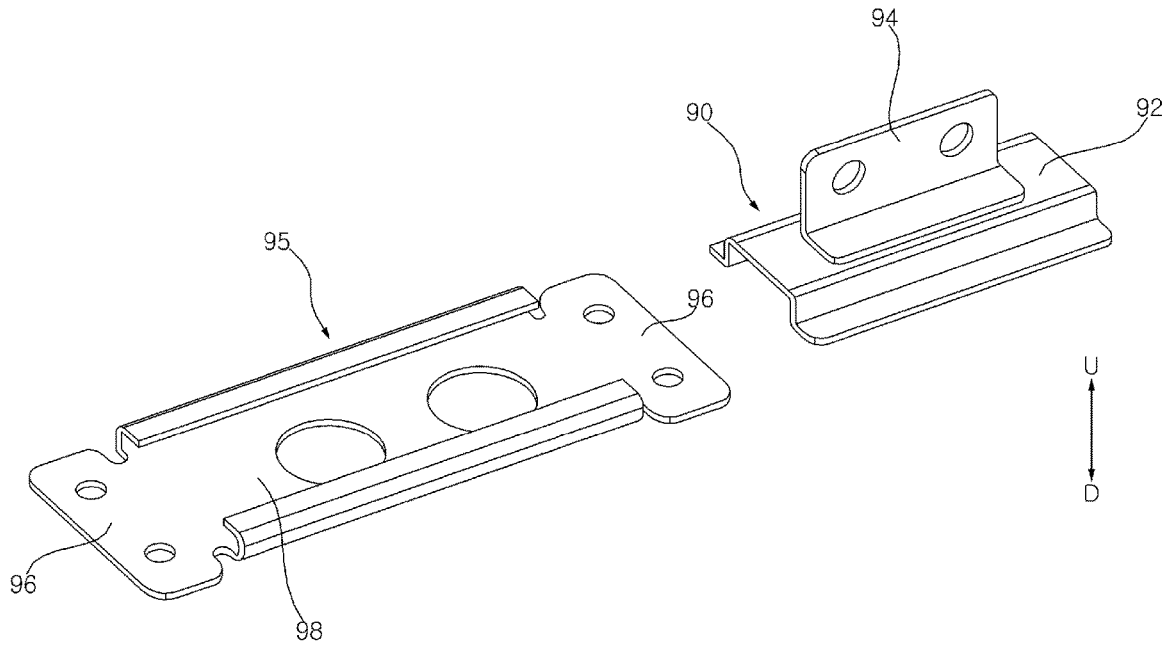
FIG. 13 is a perspective view of a state in which the bracket and the bracket guider are separated from each other, according to the first embodiment of the present disclosure.

Referring to FIG. 13, the bracket guider 95 includes a pair of fastening parts 96 fastened to the variable panel 50, and a guide part 98 disposed between the pair of fastening parts 96 and guiding movement of the bracket 90. The guide part 98, which is bent upward from both ends in the left-right direction, may prevent separation of the bracket 90 and may guide forward and backward movement of the bracket 90.

The bracket 90 includes a moving plate 92 moving forward and backward along the guide part 98, and a coupling plate 94 coupled to one side of the driving device 100. The moving plate 92 and the coupling plate 94 may be disposed perpendicular to each other.

Figure 14:
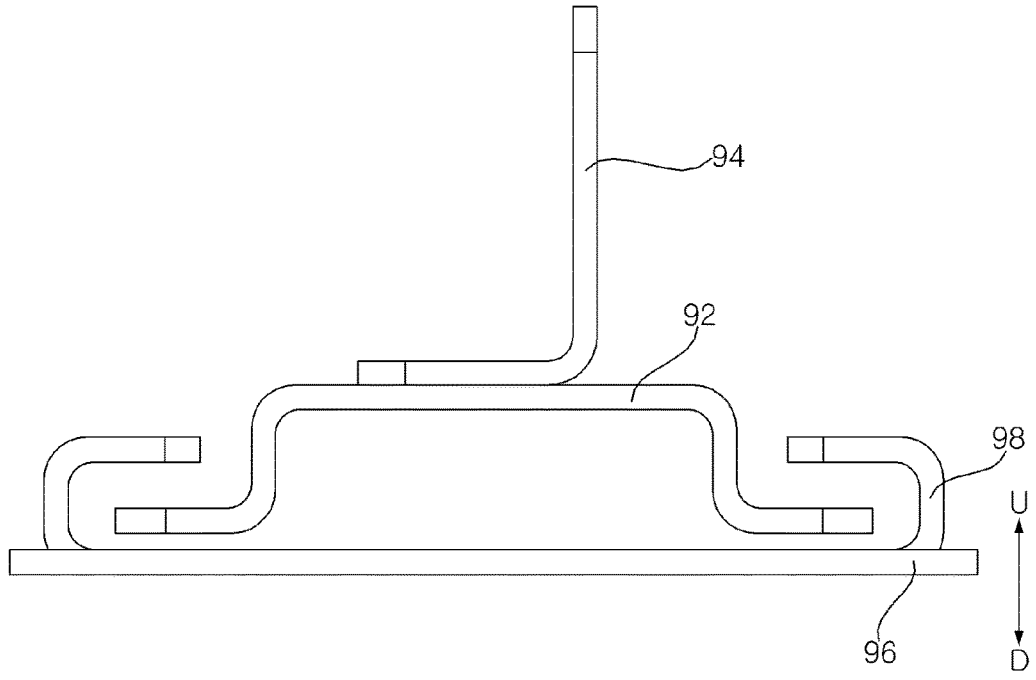
FIG. 14 is a side view of FIG. 12.
Figure 15:
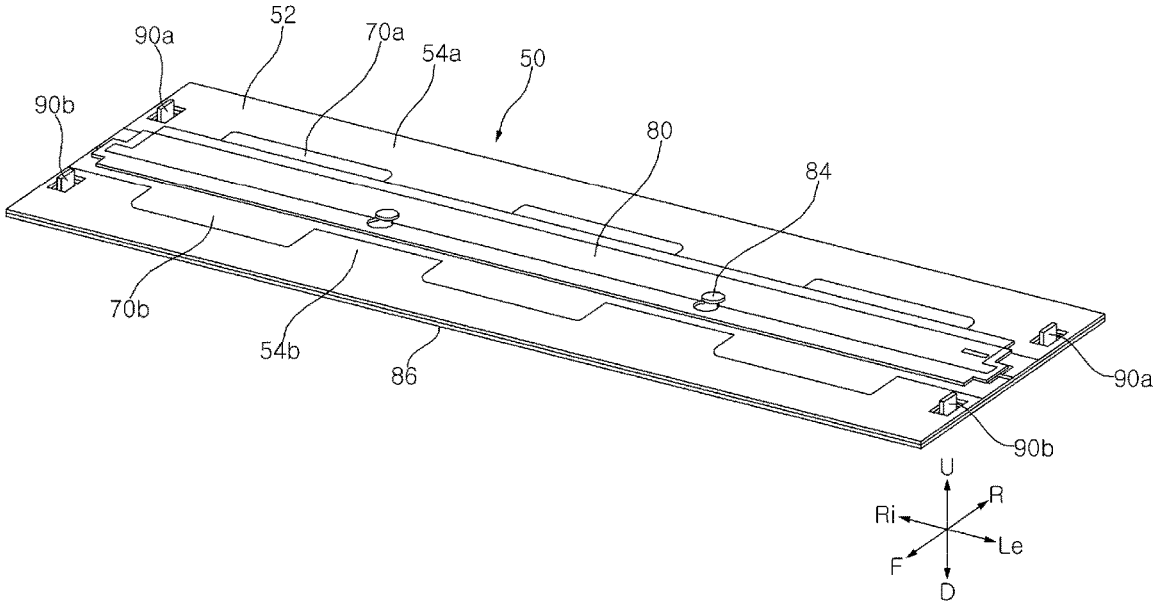
FIG. 15 is a perspective view of a state in which the variable panel, the cover panel, and the moving panel of the air conditioner are coupled to each other, according to the first embodiment of the present disclosure.
Figure 16:
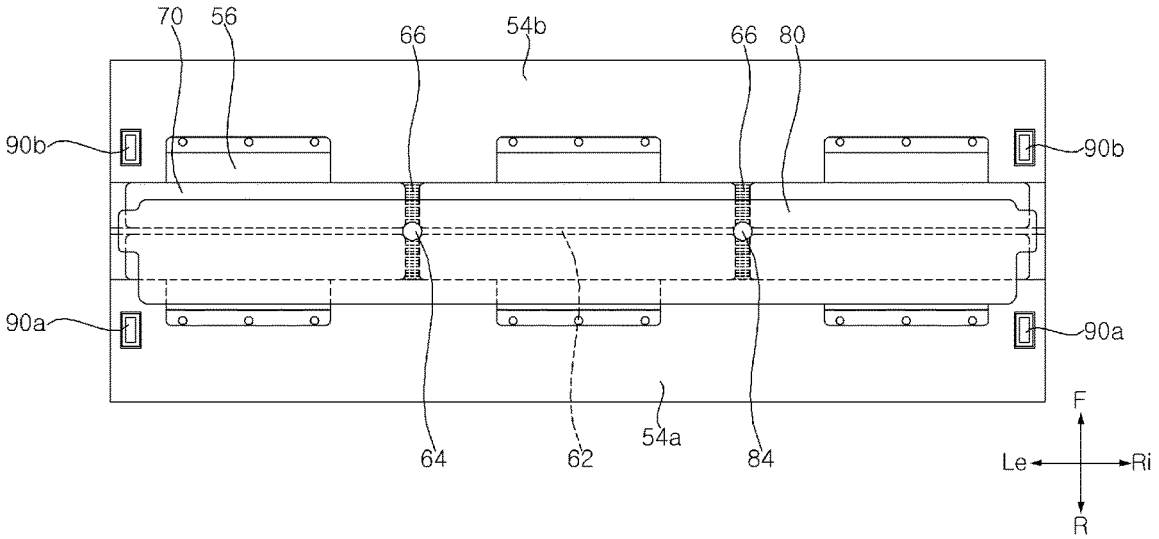
FIG. 16 is a plan view of FIG. 15.
Figure 17:
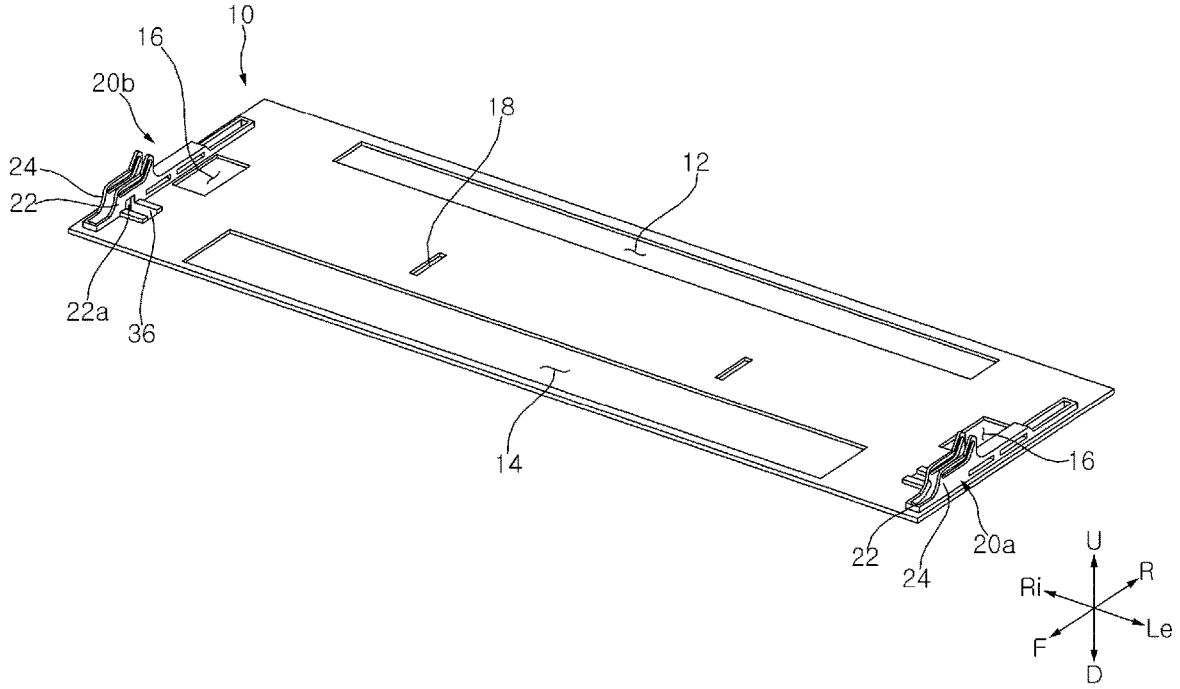
FIG. 17 is a perspective view of a base panel according to the first embodiment of the present disclosure.

By the operation of the driving device 100, the bracket 90 moves upward and downward, and by moving upward and downward, the bracket 90 may move forward and backward within the bracket guider 95. Referring to FIG. 14, both ends in the left-right direction of the moving plate 92 may be disposed in a bending structure formed at both ends in the left-right direction of the guide part 98 of the bracket guider 95.

Base Panel>

Figure 18:
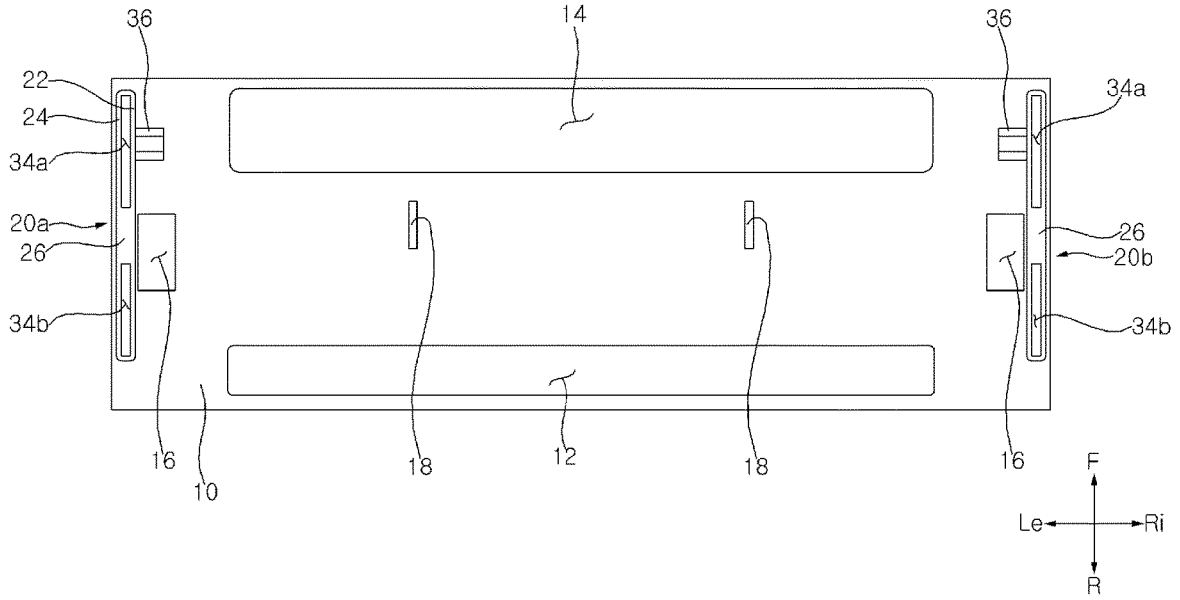
FIG. 18 is a plan view of FIG. 17.

The base panel 10 has the first communication hole 12 through which air is introduced, and the second communication hole 14 through which air flowing through the main body is discharged. The first communication hole 12 and the second communication hole 14 are spaced apart from each other in the front-rear direction. Referring to FIG. 18, the second communication hole 14 is spaced forward from the first communication hole 12. Referring to FIG. 18, an area of the second communication hole 14 may be smaller than an area of the first communication hole 12.

The base panel 10 has a motor hole 16 formed in a region in which the second motor 122 of the driving device 100 to be described below is disposed. The motor hole 16 is formed as an opening in the front-rear direction, the opening corresponding to a distance the second motor 122 and the second motor mounter 84 moves in the front-rear direction.

A hook groove 18, which is recessed upward and in which the fixed hook 64 is disposed, is formed in a lower surface of the base panel 10. The hook groove 18 may be formed at an upper side where the fixed hook 64 is disposed. The hook groove 18 may guide forward and backward movement of the fixed hook 64 that moves together with the moving panel 80.

The base panel 10 includes a panel guider 20 in which the driving device 100 is disposed. Gear holes 34*a* and 34*b*, through which panel moving plates 102 and 116 of the driving device 100 that will be described below may pass, are formed in the base panel 10.

The panel guider 20 includes a first panel guider 20*a* disposed at a left end of the base panel 10, and a second panel guider 20*b* disposed at a right end of the base panel 10.

The first panel guider 20*a* is disposed on the left side of the first communication hole 12 and the second communication hole 14 which are formed in the base panel 10. The second panel guider 20*b* is disposed on the right side of the first communication hole 12 and the second communication hole 14 which are formed in the base panel 10.

Each of the first panel guider 20*a* and the second panel guider 20*b* includes a pair of guide walls 22 and 24 which are horizontally spaced apart from each other.

Each of the first panel guider 20*a* and the second panel guider 20*b* includes a first guide wall 22, and a second guide wall 24 which is horizontally spaced apart from the first guide wall 22. Each of the first panel guider 20*a* and the second panel guider 20*b* may include an upper wall 26 connecting upper ends of the first guide wall 22 and the second guide wall 24.

The first guide wall 22 and the second guide wall 24 may have corresponding shapes. The first guide wall 22 may be disposed closer to the first communication hole 12 or the second communication hole 14 than the second guide wall 24. The first guide wall 22 and the second guide wall 24 may protrude upward from the base panel 10.

Figure 19:
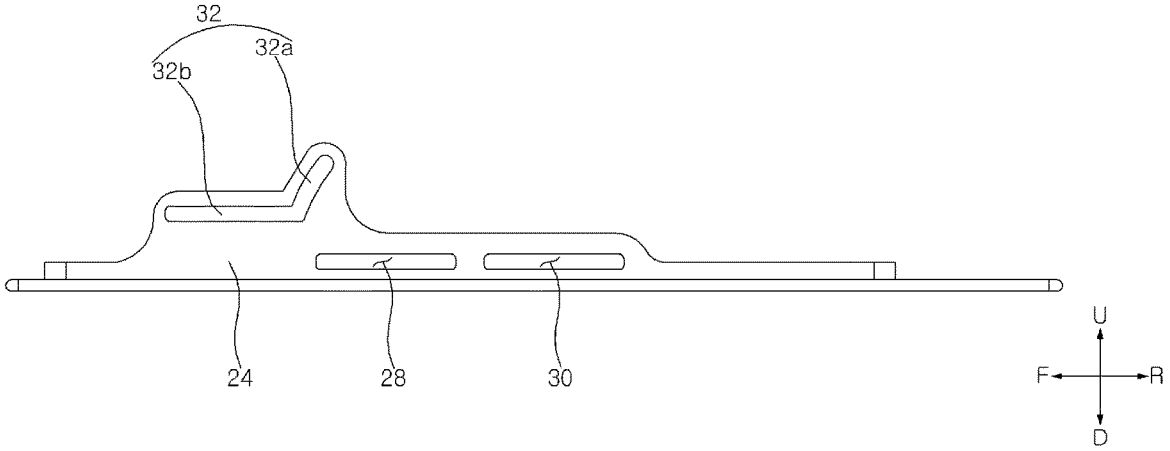
FIG. 19 is a side view of FIG. 17.
Figure 20:
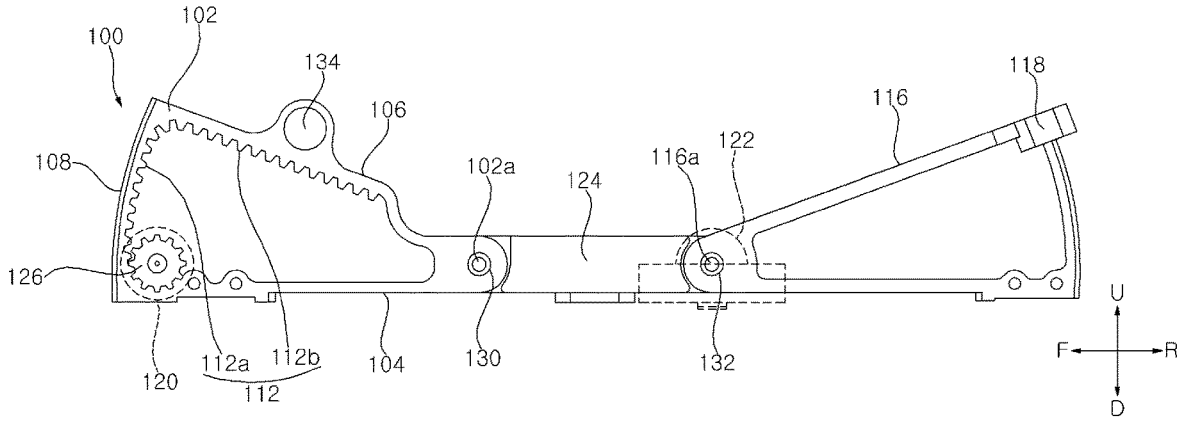
FIG. 20 is a side view of the driving device according to the first embodiment of the present disclosure.
Figure 21:
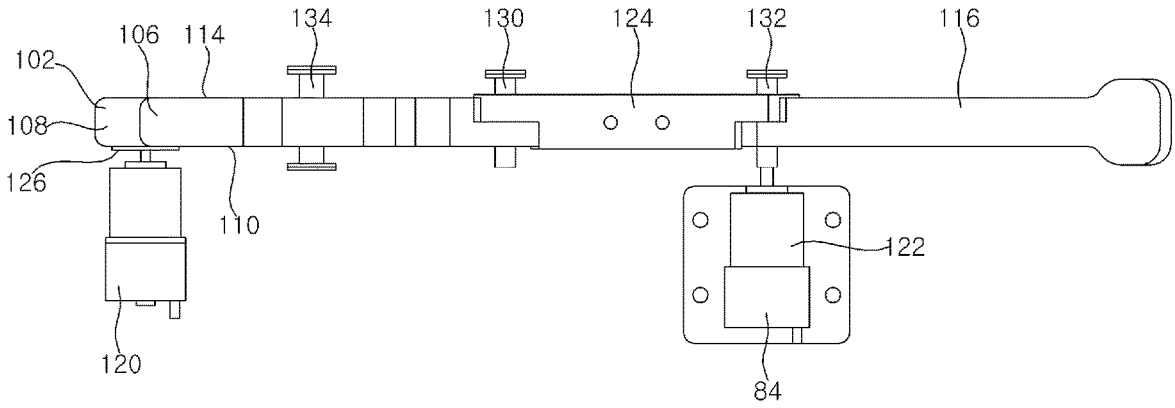
FIG. 21 is a plan view of FIG. 20.
Figure 22:
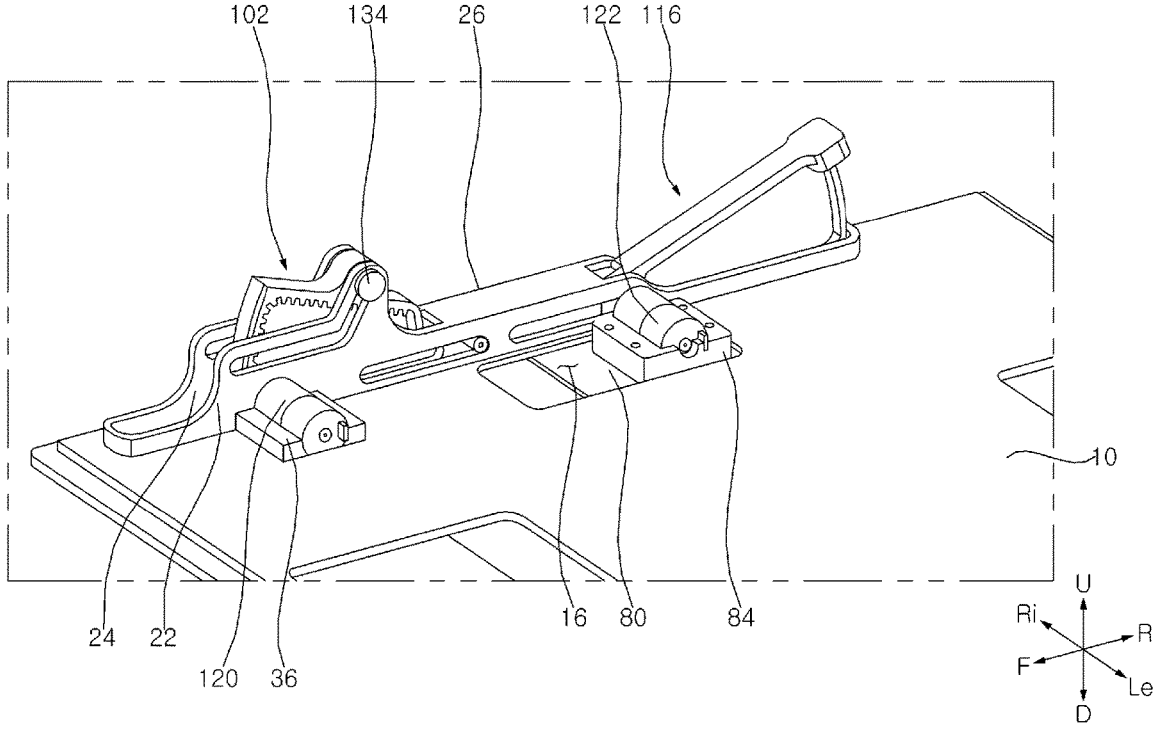
FIG. 22 is a perspective view of a state in which the driving device, coupled to the variable panel, is disposed on a base panel, according to the first embodiment of the present disclosure.

Referring to FIG. 19, each of the first guide wall 22 and the second guide wall 24 includes a first guide hole 28 guiding movement of a first rotating shaft 102*a* of a first panel moving plate 102 which will be described below, a second guide hole 30 guiding movement of a second rotating shaft 116*a* of a second panel moving plate 116 which will be described below, and a third guide hole 32 guiding movement of the first panel moving plate 102.

The first guide hole 28 and the second guide hole 30 may have a shape of a straight hole extending in the front-rear direction. The length of the first guide hole 28, extending in the front-rear direction, may be equal to a length of the second guide hole 30 extending in the front-rear direction.

The third guide hole 32 includes a curved guide hole 32*a* extending circumferentially from a position spaced apart from the first rotating shaft 102*a* by a predetermined distance, and a linear guide hole 32*b* extending rearward from a lower end of the curved guide hole 32*a*. The third guide hole 32 is disposed above the first guide hole 28 or the second guide hole 30.

A length of each of the first guide hole 28 and the second guide hole 30 extending in the front-rear direction may be equal to a length of the linear guide hole 32*b* extending in the front-rear direction.

The first guide hole 28, the second guide hole 30, and the third guide hole 32 may serve to suspend the variable panel 50 from the base panel 10 by the panel moving plates 102 and 116.

The gear holes 34*a* and 34*b*, through which the panel moving plates 102 and 116 pass, are formed in the base panel 10 between the first guide wall 22 and the second guide wall 24. A first hole 34*a*, through which the first panel moving pate 102 passes, and a second hole 34*b*, through which the second panel moving plate 116 passes, are formed between the first guide wall 22 and the second guide wall 24 in the base panel 10.

A first motor mounter 36, on which the first motor 120 of the driving device 100 which will be described below is mounted, is disposed on one side of the first guide wall 22. The first motor mounter 36 is fixed to an upper surface of the base panel 10. Accordingly, the first motor 120 mounted on the first motor mounter 36 is fixed onto the top of the base panel 10. A motor shaft hole 22*a*, through which a rotating shaft of the first motor 120 passes, is formed in the first guide wall 22.

Driving Device>

The driving device 100 may include a first driving device configured to change a shape of the variable panel 50, and a second driving device configured to move a position of the variable panel 50.

The first driving device may include the first motor 120 and the first panel moving plate 102 which will be described below. In addition, the first driving device includes the second motor 122 and the second panel moving plate 116 which will be described below. The second driving device may include the first motor 120 and the first panel moving plate 102 which will be described below. That is, the first panel moving plate 102 and the first motor 120 may be included in the first driving device as well as in the second driving device. However, the second panel moving plate 116 and the second motor 122 may be included only in the first driving device.

The driving device 100 includes the first panel moving plate 102 for changing a position of the first plate 54*a* of the variable panel 50, the second panel moving plate 116 for changing a position of the second plate 54*b* of the variable panel 50, the first motor 120 coupled to the first panel moving plate 102 to change the position of the first panel moving plate 102, and the second motor 122 coupled to the second panel moving plate 116 to change the position of the second panel moving plate 116.

The driving device 100 may further include a spacer 124 for maintaining a distance between the first rotating shaft 102*a* of the first panel moving plate 102 and the second rotating shaft 116*a* of the second panel moving plate 116.

The driving device 100 may include a motor gear 126 rotating in connection with the motor rotating shaft 120*a* of the first motor 120, and engaged with a gear surface of the first panel moving plate 102.

The driving device 100 may include a first guide pin 130 extending in the left-right direction along the first rotating shaft 102*a* of the first panel moving plate 102, a second guide pin 132 extending in the left-right direction along the second rotating shaft 116*a* of the second panel moving plate 116, and a third guide pin 134 radially spaced apart from the first rotating shaft 102*a* of the first panel moving plate 102 and extending in the left-right direction from one side of the first panel moving plate 102.

The first guide pin 130 may move along the first guide hole 28 formed in each of the first guide wall 22 and the second guide wall 24. The second guide pin 132 may move along the second guide hole 30 formed in each of the first guide wall 22 and the second guide wall 24. The third guide pin 134 may move along the third guide hole 32 formed in each of the first guide wall 22 and the second guide wall 24.

The second guide pin 132 may connect the second motor 122 and the second panel moving plate 116. Accordingly, when the second motor 122 is activated, the second guide pin 132 may change a position of the second panel moving plate 116.

Each of the first panel moving plate 102 and the second panel moving plate 116 may be formed as a fan-shaped plate. The first panel moving plate 102 may be connected on one side to the bracket 90. The bracket 90 is disposed to be coupled to a lower portion of each of the first panel moving plate 102 and the second panel moving plate 116.

The first panel moving plate 102 rotates about the first rotating shaft 102*a*. The first panel moving plate 102 includes a lower surface 104 facing the variable panel 50, an upper surface 106 disposed opposite the lower surface 104 and inclined with respect to the lower surface 104, and an outer peripheral surface 1008 connecting end portions of the lower surface 104 and the upper surface 106 and forming a curved surface. The first panel moving plate 102 includes an inner surface 110 facing the first motor 120, and an outer surface 114 facing a direction opposite the inner surface 110. A gear surface 112, engaged with the motor rotating shaft 120*a* coupled to the first motor 120, is formed on the inner surface 110 of the first panel moving plate 102. The gear surface 112 is spaced apart from the outer peripheral surface 108 and the upper surface 106 by a predetermined distance, and is formed to face the first rotating shaft 102*a*.

The gear surface 112 includes a first gear surface 112*a* spaced apart from the outer peripheral surface 108, and a second gear surface 112*b* spaced apart from the upper surface 106. The outer peripheral surface 108 and the first gear surface 112*a* may have an arc shape. The outer peripheral surface 108 and the first gear surface 112*a* may have the same center of the arc. The first gear surface 112*a* and the second gear surface 112*b* may have a structure in which the motor gear 126 may be continuously engaged therewith.

The second gear surface 112*b* may be formed approximately parallel to the upper surface 106.

The first guide pin 130 is disposed on the first rotating shaft 102*a* of the first panel moving plate 102. The first guide pin 130 may extend around the first rotating shaft 102*a* and may be formed by passing through the first panel moving plate 102.

The third guide pin 134 may be disposed on the upper surface 106. The third guide pin 134 may protrude upward above a straight surface formed by the upper surface 106.

The second panel moving plate 116 is directly coupled to the second motor 122 at the second rotating shaft 116*a*. A stopper 118 for limiting downward movement of the second panel moving plate 116 may be disposed on an upper surface of the second panel moving plate 116.

The stopper 118 protrudes horizontally from the upper surface of the second panel moving plate 116. When the second panel moving plate 116 rotates downward, the stopper 118 comes into contact with upper ends of the pair of guide walls 22 and 24, to stop the rotation of the second panel moving plate 116.

The spacer 124 maintains a distance between the first rotating shaft 102 of the first panel moving plate 102 and the second rotating shaft 116*a* of the second panel moving plate 116. The spacer 124 is connected on one side to the first guide pin 130 disposed on the first panel moving plate 102, and is connected on another side to the second guide pin 132 disposed on the second panel moving plate 116.

The first motor 120 is disposed on the first motor mounter 36 disposed on the base panel 10. Accordingly, even when the first panel moving plate 102 or the second panel moving plate 116 moves forward and backward from the base panel 10, the first motor 120 may be fixed in position.

The second motor 122 is disposed on the second motor mounter 84 disposed on an upper side of the moving panel 80. Accordingly, when the first panel moving plate 102 or the second panel moving plate 116 moves forward and backward from the base panel 10, the second motor 122 may move together.

The first panel moving plate 102 may change the position of the first plate 54*a*. Accordingly, when the first motor 120 is activated, the outer peripheral surface of the first panel moving plate 102 may move downward, such that the first plate 54*a* may be inclined downward from the base panel 10. In this case, the first communication hole 12 of the base panel 10 may be opened.

The second panel moving plate 116 may change the position of the second plate 54*b*. Accordingly, when the second motor 122 is activated, the outer peripheral surface of the second panel moving plate 116 may move downward, such that the second plate 54*b* may be inclined downward from the base panel 10. In this case, the second communication hole 14 of the base panel 10 may be opened.

Operation>

Hereinafter, the position of the variable panel 50 during the operation of the first motor 120 or the second motor 122 will be described with reference to FIGS. 23 to 27.

The variable panel 50 may be disposed in a first position P1 in which the first communication hole 12 and the second communication hole 14, which are formed in the base panel 10, are closed; a second position P2 in which a portion of the variable panel 50 is bent so as to open the first communication hole 12 and the second communication hole 14; and a third position P3 in which the variable panel 50 moves in a direction in which the second communication hole 14 is formed.

Figure 23:
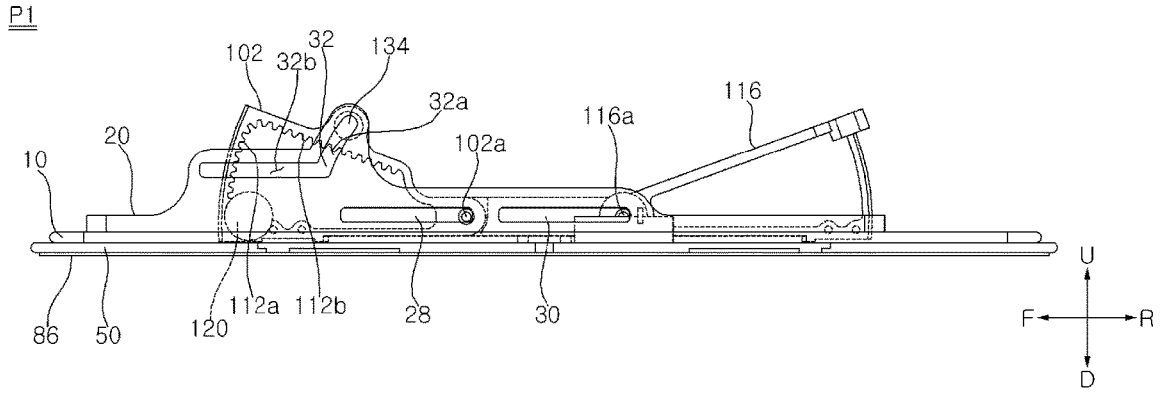
FIG. 23 is a diagram explaining arrangement of the driving device and the variable panel when the variable panel is in a first position P1 according to the first embodiment of the present disclosure.

In the first position P1, the variable panel 50 is disposed to cover the bottom of the base panel 10. The variable panel 50 may have a greater area than the base panel 10. Referring to FIG. 23, when in the first position P1, the variable panel 50 may cover the entire base panel 10 in the front-rear direction. Accordingly, when the variable panel 50 is disposed in the first position P1, the base panel 10 may not be seen from an occupant present in a lower part of an indoor space.

Figure 24:
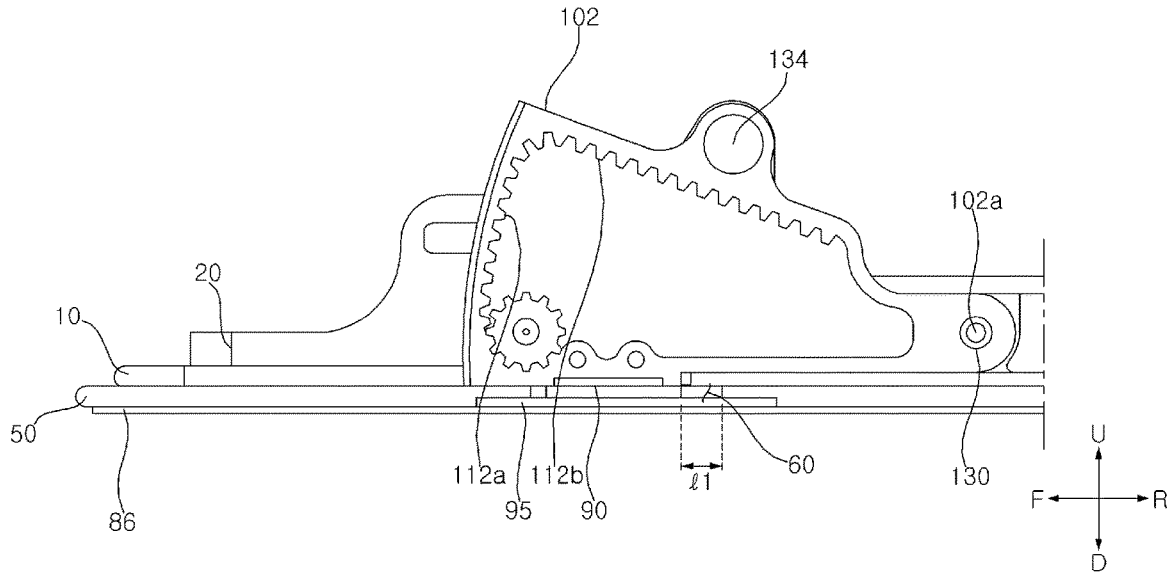
FIG. 24 is a diagram explaining arrangement of the bracket disposed on the variable panel when the variable panel is in the first position P1 according to the first embodiment of the present disclosure.
Figure 25:
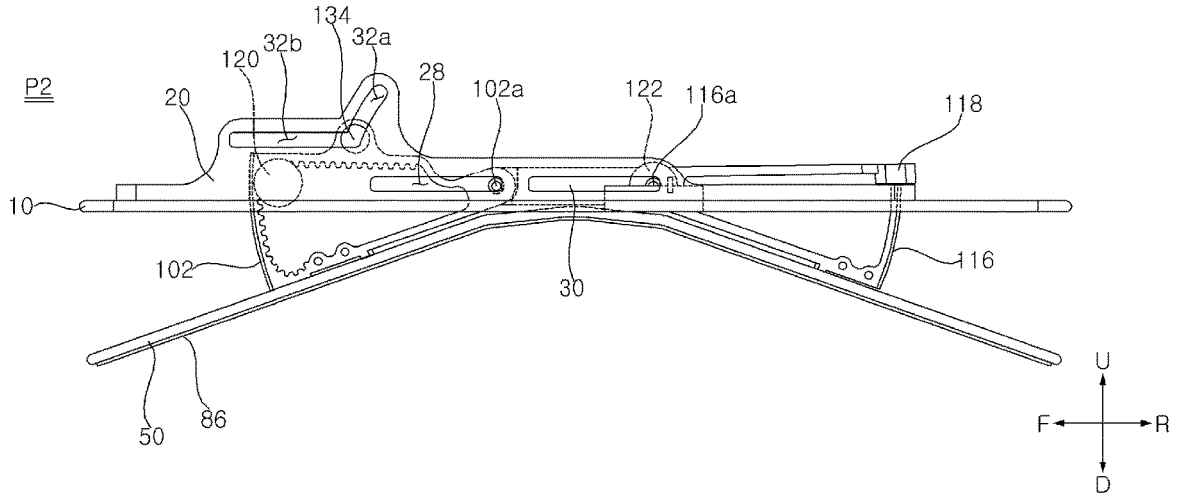
FIG. 25 is a diagram explaining arrangement of the driving device and the variable panel when the variable panel is in a second position P2 according to the first embodiment of the present disclosure.

When the variable panel 50 is disposed in the first position P1, the first motor 120 may be disposed at a lower end of the first gear surface 112*a* of the first panel moving plate 102. Referring to FIG. 24, when the variable panel 50 is disposed in the first position P1, one end of the bracket 90 may remain spaced apart a first distance 11 from one end of the bracket hole 60.

By the operation of the first motor 120 and the second motor 122, the variable panel 50 may be changed in shape from the first position P1 to the second position P2. By the operation of the first motor 120, the motor gear 126 may move along the first gear surface 112*a* of the first panel moving plate 102. In this case, the first flexible body 70*a* is bent, and the first plate 54*a* moves downward. When the variable panel 50 is in the second position P2, the second communication hole 14 may be opened.

Figure 26:
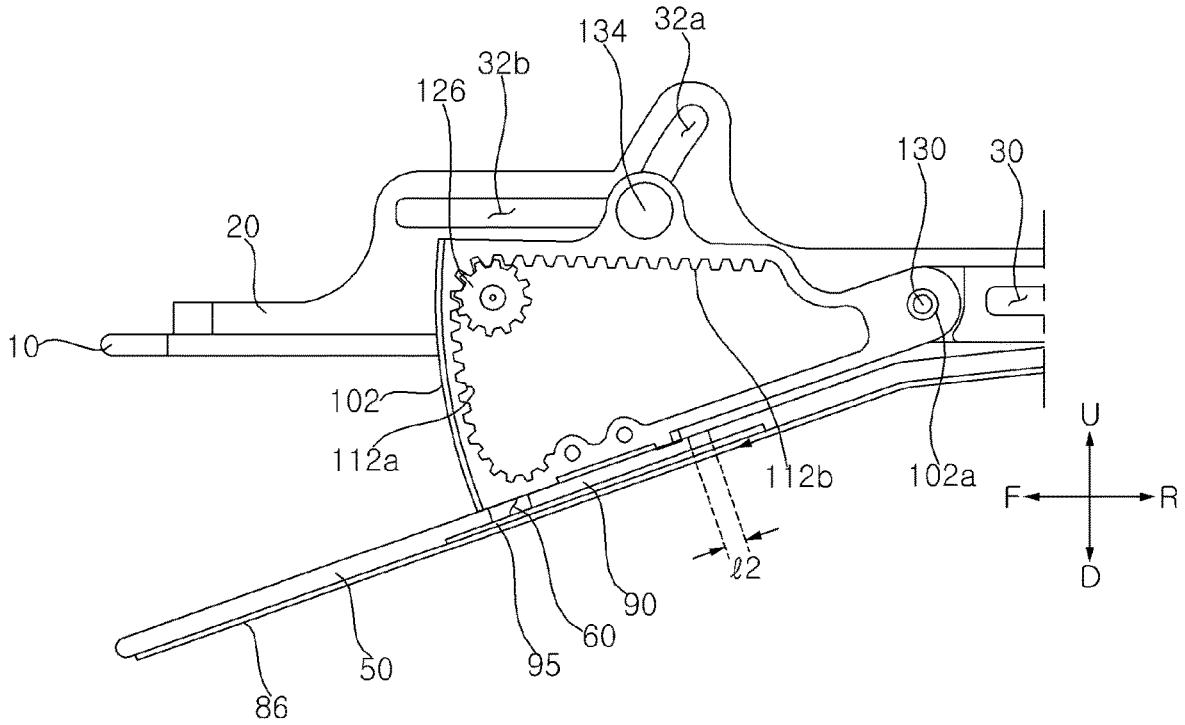
FIG. 26 is a diagram explaining arrangement of the bracket disposed on the variable panel when the variable panel is in the second position P2 according to the first embodiment of the present disclosure.
Figure 27:
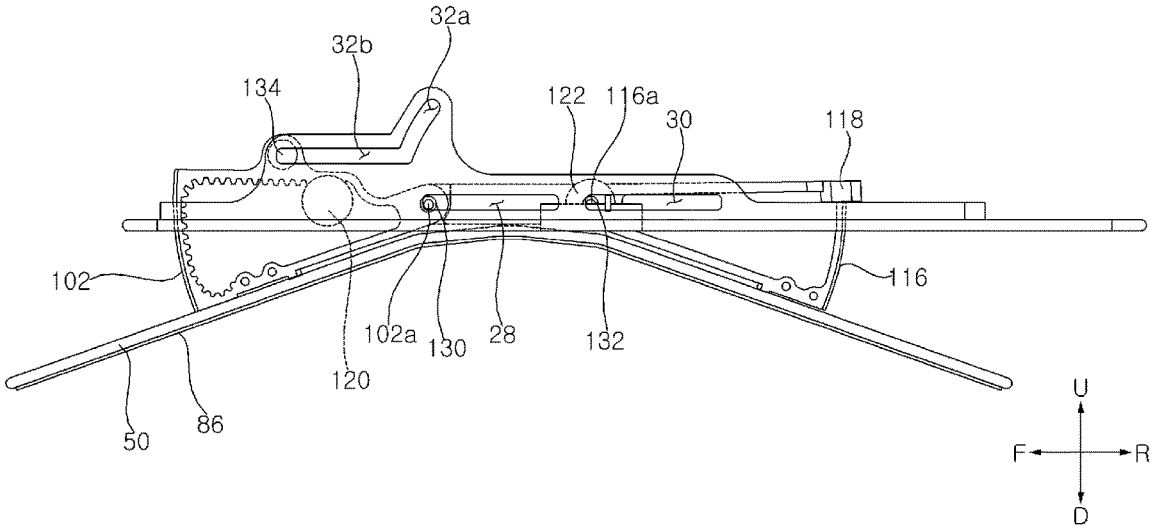
FIG. 27 is a diagram explaining arrangement of the driving device and the variable panel when the variable panel is in a third position P3 according to the first embodiment of the present disclosure.
Figure 28:
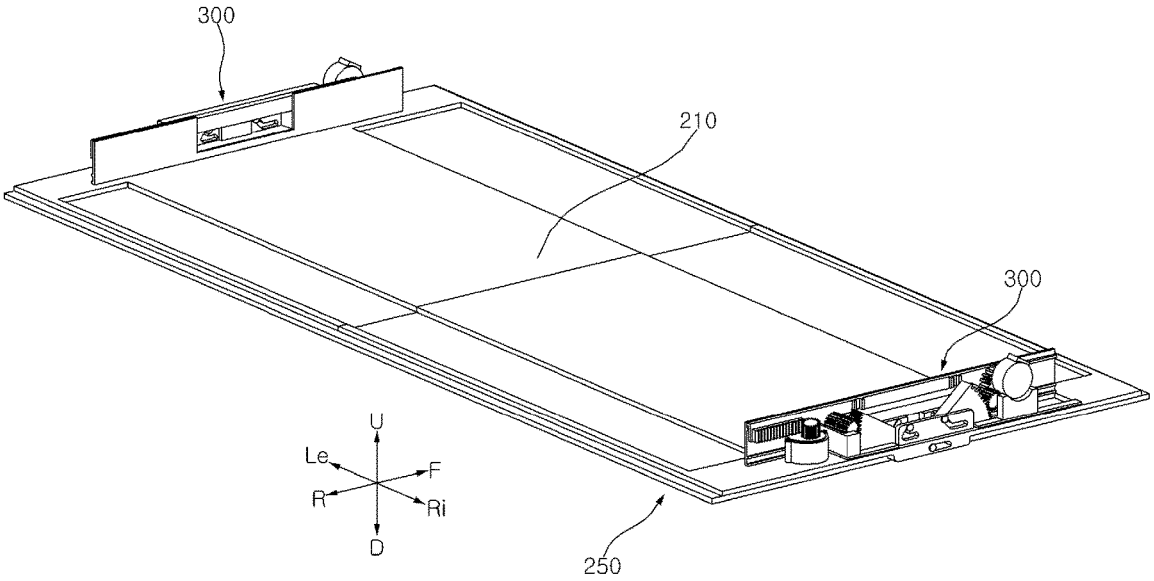
FIG. 28 is a perspective view of a state in which a base panel, a variable panel, and a driving device of an air conditioner are coupled to each other according to a second embodiment of the present disclosure.

When the variable panel 50 is changed in shape from the first position P1 to the second position P2, the motor gear 126 moves along the first gear surface 112*a*. When the variable panel 50 is changed in shape from the first position P1 to the second position P2, the third guide pin 134 moves along the curved guide hole 32*a* of the third guide hole 32. Accordingly, the outer peripheral surface of the first panel moving plate 102 may also move downward. The first panel moving plate 102 rotates downward about the first rotating shaft 102*a*. Referring to FIG. 26, when the variable panel 50 is in the second position P2, the motor gear 126 may be disposed at a portion where the first gear surface 112*a* and the second gear surface 112*b* meet.

By the operation of the second motor 122, the second panel moving plate 116 rotate about the second rotating shaft 116*a*. In this case, the second flexible body 70*b* is bent, and the second plate 54*b* moves downward. When the variable panel 50 is in the second position P2, the first communication hole 12 may be opened. When the variable panel 50 is in the second position P2, the stopper 118 of the second panel moving plate 116 may come into contact with the upper ends of the guide walls 22 and 24.

Referring to FIG. 26, when the variable panel 50 is in the second position P2, one end of the bracket 90 may remain spaced apart a second distance 12 from one end of the bracket hole 60. The second distance 12 may be different from the first distance 11. Referring to FIGS. 24 and 26, the second distance 12 may be smaller than the first distance 11.

In addition, when the first motor 120 is activated, the variable panel 50 may move from the second position P2 to the third position P3.

When the variable panel 50 moves from the second position P2 to the third position P3, the motor gear 126 may move along the second gear surface 112*b*. When the variable panel 50 moves from the second position P2 to the third position P3, the third guide pin 134 may move along the linear guide hole 32*b* of the third guide hole 32. When the variable panel 50 moves from the second position P2 to the third position P3, the first guide pin 130 and the second guide pin 132 may move along the first guide hole 28 and the second guide hole 30, respectively.

When the variable panel 50 moves from the second position P2 to the third position P3, the central rib 62 of the variable panel 50 may move in a direction in which the second communication hole 14 is formed.

In a structure in which the air in the air conditioner is discharged through the second communication hole 14, a contact area between the air, discharged through the second communication hole 14, and the variable panel 50 may increase, leading to an increase in a guided area of the air guided by the variable panel 50 when the air is discharged through the second communication hole 14.

Further, in a structure in which the air is drawn into the air conditioner through the second communication hole 14, an opening area of the second communication hole 14 increases, leading to an increase in an amount of air flowing into the air conditioner.

Second Embodiment

Hereinafter, a variable panel, a driving device, and a base panel according to the second embodiment will be described with reference to FIGS. 28 to 36.

A variable panel 250 according to the second embodiment includes a first variable panel 252 which is disposed under the base panel 210 and changed in position at a lower side of the first communication hole 212, and a second variable panel 260 which is disposed under the base panel 210 and changed in position at a lower side of the second communication hole 214.

One of the first communication hole 212 and the second communication hole 214 may be an inlet through which outside air is drawn into the air conditioner. The other one of the first communication hole 212 and the second communication hole 214 may be an outlet through which air in the air conditioner is discharged to the outside.

The first variable panel 252 may open and close the first communication hole 212. The second variable panel 260 may open and close the second communication hole 214. An inclination angle of the first variable panel 252 may be changed at the lower side of the first communication hole 212. Here, the inclination angle may refer to an angle between surfaces formed by each of the first variable panel 252 and the base panel 210. An inclination angle of the second variable panel 260 may be changed at the lower side of the second communication hole 214.

The variable panel 250 may include a fixed part which is fixed in position vertically relative to the base panel 210, a cover part spaced apart from the fixed part and disposed at a lower side of the first communication hole 212 or the second communication hole 214, and a variable part disposed between the fixed part and the cover part and changing an inclination angle of the cover part.

The fixed part may be a hinge 270 which will be described below. Further, the variable part may be the hinge 270 which will be described below. The cover part may be the first variable panel 252 or the second variable panel 260. The hinge 270 may be disposed on a first rotation axis 270*a* around which the first variable panel 252 or the second variable panel 260 rotate.

The variable panel 250 may include the hinge 270 rotatably connecting the first variable panel 252 and the second variable panel 260.

The hinge 270 may rotatably connect each of the first variable panel 252 and the second variable panel 260. Accordingly, the position of each of the first variable panel 252 and the second variable panel 260 may be changed with respect to the hinge 270. The inclination angle of each of the first variable panel 252 and the second variable panel 260 may be changed with respect to the hinge 270.

A third pin 272 for guiding forward and backward movement of the hinge 270 may be disposed on one side of the hinge 270. The third pin 272 may move together with the hinge 270. The third pin 272 may move together with the variable panel 250 when the variable panel 250 moves forward and backward.

The first variable panel 252 is coupled to a first plate 254, and a pair of first panel gears 256 disposed at both ends of the first plate 254 and coupled to a driving device 300 to change arrangement of the first plate 254.

The first panel gears 256 may be formed in a fan shape. A first gear surface 256*a*, engaged with a first gear 306 to be described below, may be formed on an outer circumferential surface of the first panel gears 256. Here, the outer circumferential surface may refer to a surface extending circumferentially at a position radially spaced apart from the center of rotation of the fan-shaped first panel gears 256.

Figure 29:
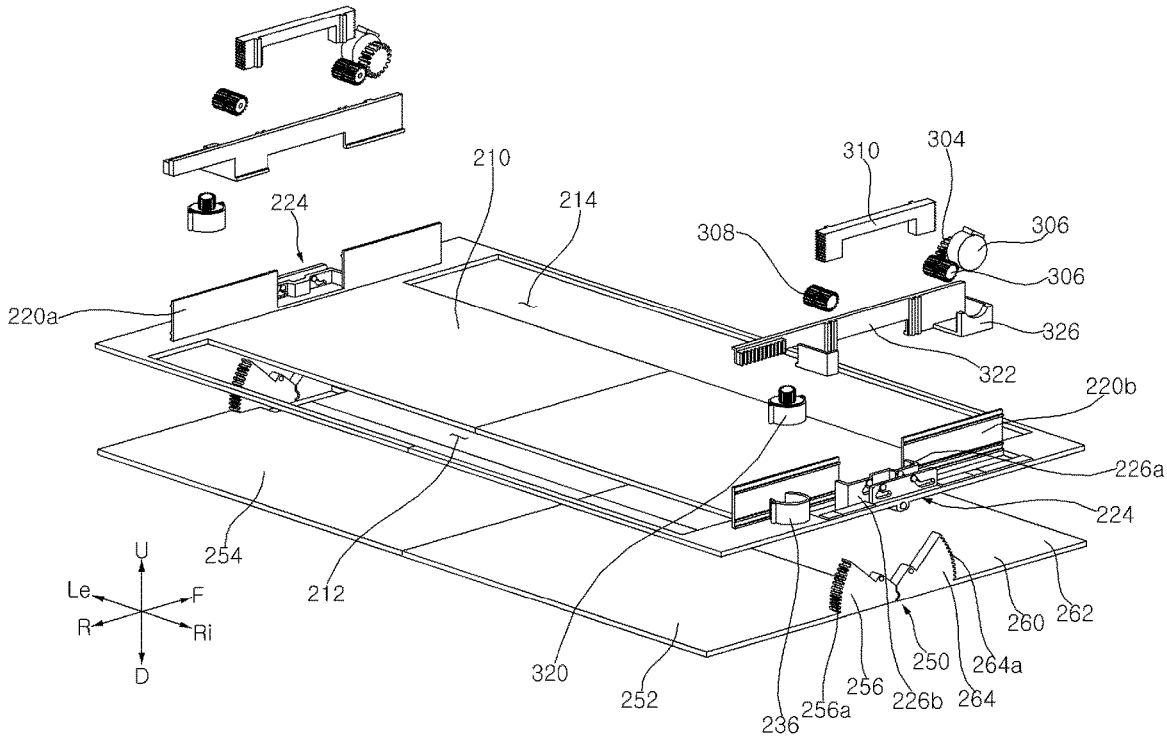
FIG. 29 is an exploded perspective view of the base panel, the variable panel, and the driving device of the air conditioner according to the second embodiment of the present disclosure.
Figure 30:
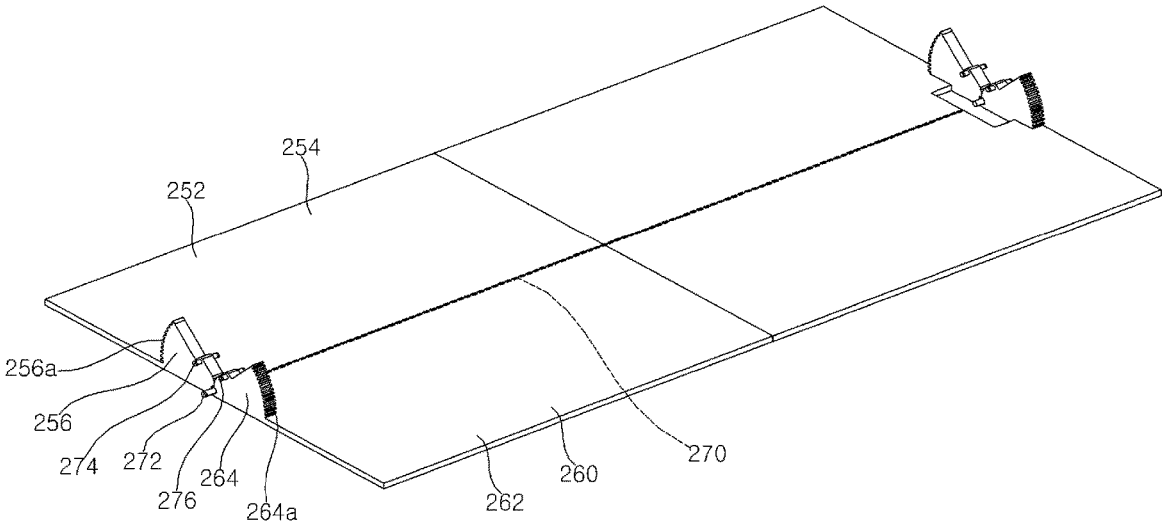
FIG. 30 is a perspective view of the variable panel according to the second embodiment of the present disclosure.
Figure 31:
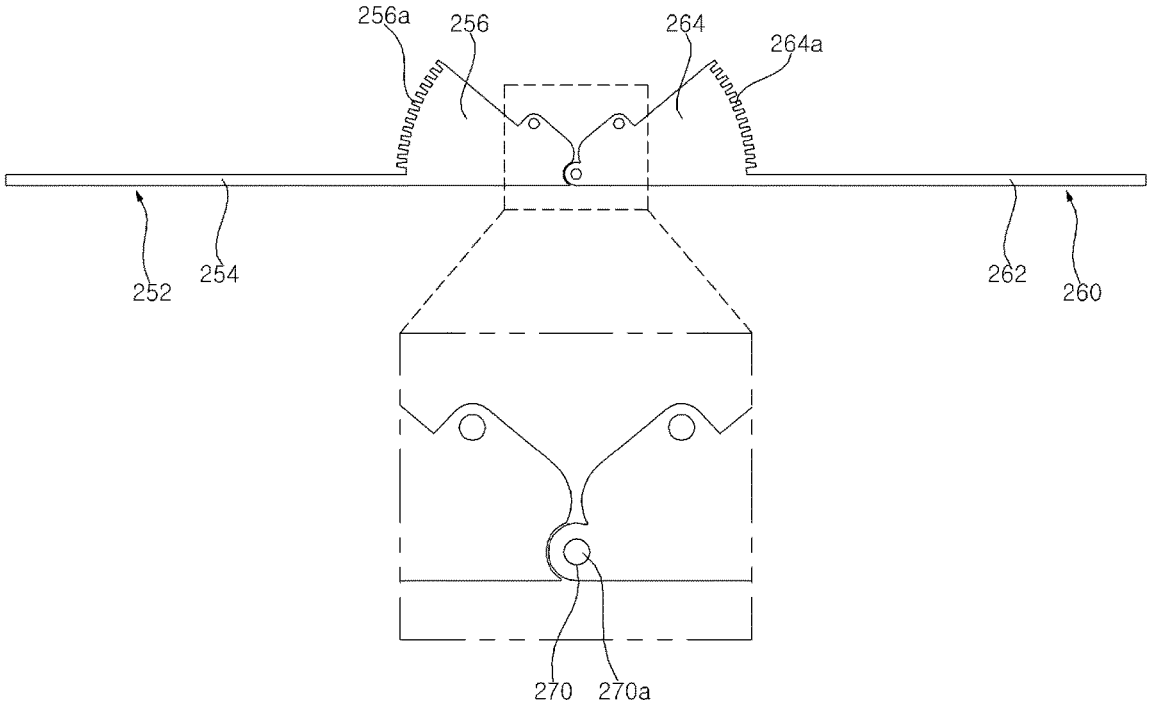
FIG. 31 is a side view of one side of the variable panel, from which a plurality of pins are removed, according to the second embodiment of the present disclosure.

The first panel gears 256 may have a structure in which a lower end thereof is connected to the first plate 254. Referring to FIG. 29, the lower end of the first panel gears 256 may be disposed to come into contact with an upper end of the first plate 254. The first panel gears 256 and the first plate 254 may be formed as one body.

An upper surface of the first panel gears 256 may be inclined upward from the first plate 254.

A first pin 274 for guiding a change of arrangement or movement of position of the first panel gears 256 is disposed on one side of the first panel gears 256. The first pin 274 may be disposed on one side of an upper surface of the first panel gears 256.

The second variable panel 260 includes a second plate 262, and a pair of second panel gears 264 disposed at both ends of the second plate 262 and coupled to the driving device 300 to change arrangement of the second plate 262.

The second panel gears 264 may be formed in a fan shape. A second gear surface 264*a*, engaged with a second gear 308 to be described below, may be formed on an outer circumferential surface of the second panel gears 264.

The second panel gears 264 may have a structure in which a lower end thereof is connected to the second plate 262. Referring to FIG. 29, the lower end of the second panel gears 264 may be disposed to come into contact with an upper end of the second plate 262. The second panel gears 264 and the second plate 262 may be formed as one body.

The upper surface of the second panel gears 264 may be inclined upward from the second plate 262.

A second pin 276 for guiding a change of arrangement or movement of position of the second panel gears 264 is disposed on one side of the second panel gears 264. The second pin 276 may be disposed on one side of the upper surface of the second panel gears 264.

The driving device 300 may include a first driving device for changing a shape of the variable panel 250, and a second driving device for moving a position of the variable panel 250.

The first driving device may be a first motor 302 and a first mover 310 which will be described below. The first driving device may include a plurality of gears connected to the first motor 302 or the first mover 310.

The second driving device may be a second motor 320 and a second mover 322 which will be described below. The second driving device may include a horizontal gear 321 coupled to the second motor 320.

The driving device 300 may include the first motor 302 for changing arrangement of the variable panel 250.

The driving device 300 may include a plurality of gears coupled to the first motor 302 and changing arrangement of the first variable panel 252 or the second variable panel 260.

The driving device 300 may include the first mover 310 coupled to the first motor 302 to move up and down.

By the rotation of the first gear 306 which will be described below, the first mover 310 may rotate the second gear 308 spaced apart from the first gear 306. The first mover 310 is engaged on one side with the first gear 306 and is engaged on another side with the second gear 308.

Figure 32:
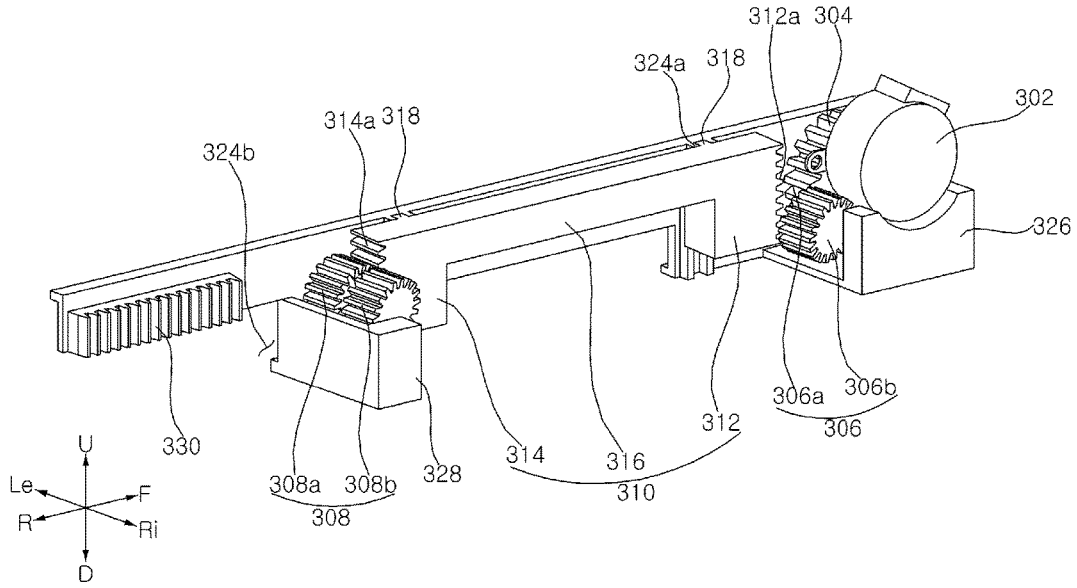
FIG. 32 is a perspective view of the driving device according to the second embodiment of the present disclosure.
Figure 33:
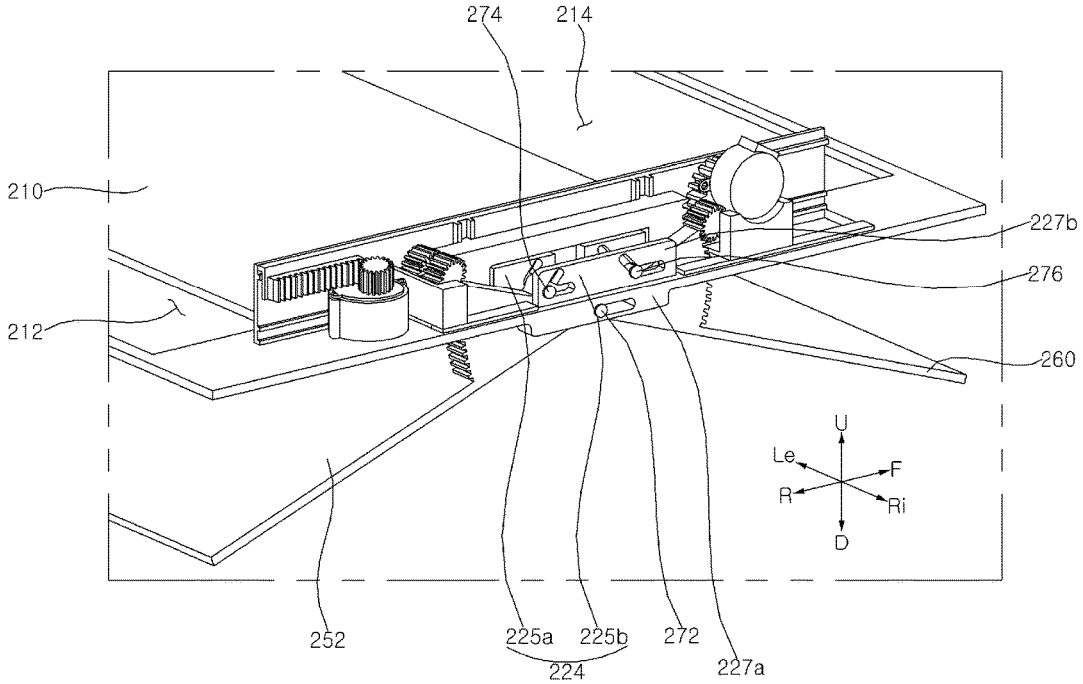
FIG. 33 is a perspective view explaining configuration of the variable panel connected to the driving device, according to the second embodiment of the present disclosure.

Referring to FIG. 32, the first mover 310 includes a first vertical bar 312 having a first rack 312*a* engaged with the first gear 306, a second vertical bar 314 spaced apart from the first vertical bar 312 and having a second rack 214*a* engaged with the second gear 308, and a horizontal bar 316 connecting the first vertical bar 312 and the second vertical bar 314.

The horizontal bar 316 may connect an upper end of the first vertical bar 312 and an upper end of the second vertical bar 314. The horizontal bar 316 may come into contact with the base panel 210 to limit downward movement of the first mover 310.

The first vertical bar 312 and the second vertical bar 314 may be spaced apart from each other in the front-rear direction. The first rack 312*a* and the second rack 214*a* may be formed in opposite directions.

The first mover 310 may include a guide rib protruding from one side thereof or a guide groove recessed from one side thereof, to guide up-and-down movement of the first mover 310. Referring to FIG. 32, a first guide 318 protruding rib from one side of the first mover 310 is disposed on the first mover 310. The first guide rib 318 may be inserted into a first guide groove 324*a* formed in the second mover 322 which will be described below.

The first guide rib 318 disposed on the first mover 310 may extend in an up-down direction in which the first mover 310 moves. The first guide rib 318 protrudes from one side of the first mover 310 in a direction in which the second mover 322 is disposed, and extends in a moving direction of the first mover 310.

Unlike the drawing, if a guide groove is vertically formed in the first mover 310, a guide rib to be inserted into the guide groove may be disposed on the second mover 322.

Referring to FIG. 32, the first guide rib 318, protruding in a direction in which the second mover 322 is disposed, may be disposed on the first mover 310. In addition, the first guide groove 324*a*, which is vertically formed so that the first guide rib 318 is inserted thereinto to move, is formed in the second mover 322.

The plurality of gears include a motor gear 304 connected to a rotating shaft of the first motor 302. The plurality of gears includes a first gear 306 engaged with the motor gear 304 to be rotated thereby, and a second gear 308 engaged with the first mover 310 to be rotated thereby.

The first gear 306 includes a first inner gear 306*a* engaged with the motor gear 304, and a first outer gear 306*b* engaged with the first panel gear 256. The first inner gear 306*a* and the first outer gear 306*b* may rotate together about the same rotation axis. The first inner gear 306*a* and the first outer gear 306*b* may be formed as separate components. The first inner gear 306*a* and the first outer gear 306*b* may be formed as one body.

The first inner gear 306*a* is engaged on one side with the motor gear 304 to be rotated. The first inner gear 306*a* is engaged on another side with one side of the first mover 310. Accordingly, when the motor gear 304 is rotated by the operation of the first motor 302, the first inner gear 306*a* is rotated such that the first mover 310 may move up and down.

The first outer gear 306*b* may be engaged with the first panel gear 256 of the first variable panel 252. Accordingly, when the motor gear 304 is rotated by the operation of the first motor 302, the first inner gear 306*a* and the first outer gear 306*b* are rotated such that arrangement of the first variable panel 252 may be changed.

The second gear 308 includes a second inner gear 308*a* engaged with another side of the first mover 310, and a second outer gear 308*b* engaged with the second panel gear 264. The second inner gear 308*a* and the second outer gear 308*b* may rotate together about the same rotation axis. The second inner gear 308*a* and the second outer gear 308*b* may be formed as separate components. The second inner gear 308*a* and the second outer gear 308*b* may be formed as one body.

The second inner gear 308*a* is engaged on one side with the first mover 310 to be rotated thereby. The second inner gear 308*a* may be engaged with the second rack 214*a* of the first mover 310. Accordingly, when the first mover 310 moves up and down, the second inner gear 308*a* engaged with the second rack 214*a* may be rotated.

The second outer gear 308*b* may be engaged with the second panel gear 264 of the second variable panel 260. Accordingly, when the first mover 310 moves up and down, the second inner gear 308*a* and the second outer gear 308*b* are rotated such that arrangement of the second variable panel 260 may be changed.

The driving device 300 includes the second mover 322 for moving a position of the variable panel 250, and the second motor 320 mounted to the base panel 210 and moving the second mover 322. The driving device 300 may include the horizontal gear 321 connected to the second motor 320 to be rotated thereby.

The second mover 322 is movably disposed on the base panel 210. The second mover 322 may move forward and backward on the base panel 210. The second mover 322 includes a moving panel 324 on which the first mover 310 is mounted, and a first motor mounting part 326 in which the first motor 302 is mounted.

The first guide groove 324*a* for guiding up-and-down movement of the first mover 310 is formed in the moving panel 324. The first guide rib 318 of the first mover 310 may be inserted into the first guide groove 324*a*.

A horizontal rack 330, engaged with the horizontal gear 321 on a surface facing the horizontal gear 321, may be disposed on the moving panel 324. When the horizontal gear 321 is rotated, the horizontal gear 321 is engaged with the horizontal rack 330 to move the second mover 322 forward and backward.

Each of the first gear 306 and the second gear 308 is rotatably disposed on the second mover 322. Each of the first gear 306 and the second gear 308 is rotatably disposed on the moving panel 324.

The first motor 302 may be mounted in the first motor mounting part 326. The first motor mounting part 326 may define a space which protrudes from one side surface of the moving panel 324 and in which the first motor 302 is mounted.

The second mover 322 may include a cover wall 328 protruding from one side of the moving panel 324 and covering one side of the second gear 308. The cover wall 328 is disposed between the second gear 308 and the second motor 320. The cover wall 328 may prevent the second gear 308 from contacting the second motor 320 or the horizontal gear 321.

The first communication hole 212 and the second communication hole 214 may be formed in the base panel 210. The first communication hole 212 and the second communication hole 214 may be spaced apart from each other in the front-rear direction.

Guide walls 220*a* and 220*b* for guiding movement of the second mover 322 may be disposed on the base panel 210. A second motor mounting part 236 for fixing a position of the second motor 320 may be disposed on the base panel 210. The second motor mounting part 236 may fix the position of the second motor 320 disposed on the base panel 210. The second motor mounting part 236 may be disposed on one side of the guide walls 220*a* and 220*b*.

A pair of guide walls 220*a* and 220*b*, which are spaced apart from each other in the left-right direction, may be disposed on the base panel 210. The pair of guide walls 220*a* and 220*b* may be disposed on the left side and the right side, respectively, of the first communication hole 212 or the second communication hole 214.

The base panel 210 includes a first guide wall 220*a* and a second guide wall 220*b* spaced apart from the first guide wall 220*a*. The first guide wall 220*a* and the second guide wall 220*b* may be symmetrical to each other in the left-right direction. The first guide wall 220*a* and the second guide wall 220*b* may include the same components.

Accordingly, the following description of the guide walls 220*a* and 220*b* may be applied to each of the first guide wall 220*a* and the second guide wall 220*b*.

The guide walls 220*a* and 220*b* include a mover guide wall 222 disposed on one side of the second mover 322, and a pin guide wall 224 having a plurality of pin guide grooves 230, 232, and 234 formed therein, in which a plurality of guide pins 272, 274, and 276 move. The mover guide wall 222 may be disposed to face the second mover 322. The mover guide wall 222 may guide forward and backward movement of the second mover 322. The mover guide wall 322 may support a position of the second mover 322. The second mover 322 may come into contact with the mover guide wall 222.

A second guide rib 223 for guiding movement of the second mover 322 may be disposed on the mover guide wall 222. A second guide groove 324*b* corresponding to the second guide rib 223 may be formed in the second mover 322.

The mover guide wall 222 includes a first mover guide wall 222*a* disposed on one side of the first communication hole 212, and a second mover guide wall 222*b* disposed on one side of the second communication hole 214. The first mover guide wall 222*a* and the second mover guide wall 222*b* may be spaced apart from each other in the front-rear direction. Each of the first mover guide wall 222*a* and the second mover guide wall 222*b* may be disposed on one side of the second mover 322.

A pair of pin guide walls 224 may be provided which are spaced apart from each other in the left-right direction. The pin guide walls 224 may include an inner guide wall 225*a* disposed adjacent to the mover guide wall 222, and an outer guide wall 225*b* spaced apart from the inner guide wall 225*a*. The inner guide wall 225*a* and the outer guide wall 225*b* may be disposed parallel to each other.

The pin guide walls 224 include a first end wall 226*a* bent and extending inwardly from a front end of the inner guide wall 225*a*, and a second end wall 226*b* bent and extending inwardly from a rear end of the inner guide wall 225*a*. The first end wall 226*a* may come into contact with the first mover guide wall 222*a*. The second end wall 226*b* may come into contact with the second mover guide wall 222*b*. Each of the first end wall 226*a* and the second end wall 226*b* may come into contact with the first mover 310 to limit forward and backward movement of the first mover 310.

The pin guide walls 224 are positioned further to the outside than the mover guide wall 222. Here, the outside may refer to a direction away from the first communication hole 212 and the second communication hole 134 which are formed in the base panel 210.

The pin guide walls 224 may include an upper guide wall 227*b* disposed on an upper side of the base panel 210 and guiding movement of the first pin 274 and the second pin 276, and a lower guide wall 227*a* disposed on a lower side of the base panel 210 and guiding movement of the third pin 272. Each of the inner guide wall 225*a* and the outer guide wall 225*b* described above may include the upper guide wall 227*b*. Each of the inner guide wall 225*a* and the outer guide wall 225*b* may include the lower guide wall 227*a*.

A third pin hole 230 for guiding movement of the third pin 272 may be formed in the pin guide wall 224. A first pin hole 232 for guiding movement of the first pin 274 may be formed in the pin guide wall 224. A second pin hole 234 for guiding movement of the second pin 276 may be formed in the pin guide wall 224.

The third pin hole 230 may be formed in the lower guide wall 227*a*. The third pin hole 230 may be open from side to side in the pin guide wall 224 and extend in the front-rear direction.

The first pin hole 232 and the second pin hole 234 may be formed in the upper guide wall 227*b*. The first pin hole 232 may guide movement of the first pin 274. The first pin hole 232 includes a first curved part 232*a* guiding a change in arrangement of the first variable panel 252, and a first straight part 232*b* guiding movement of the first variable panel 252. The first straight part 232*b* may be disposed parallel to the third pin hole 230.

The first curved part 232*a* may guide movement of the first pin 274 rotating about the hinge 270. Accordingly, the first curved part 232*a* may have an arc shape with a radius corresponding to a distance between the first pin 274 and the hinge 270.

The second pin hole 234 may guide movement of the second pin 276. The second pin hole 234 includes a second curved part 234*a* guiding a change in arrangement of the second variable panel 260, and a second straight part 234*b* guiding movement of the second variable panel 260. The second straight part 234*b* may be disposed parallel to the third pin hole 230.

The second curved part 234*a* may guide movement of the second pin 276 rotating about the hinge 270. Accordingly, the second curved part 234*a* may have an arc shape with a radius corresponding to a distance between the second pin 276 and the hinge 270.

Hereinafter, a change of shape and movement of position of the variable panel 250 by the operation of the first motor 302 and the second motor 320 will be described with reference to FIGS. 34 to 36.

Figure 34:
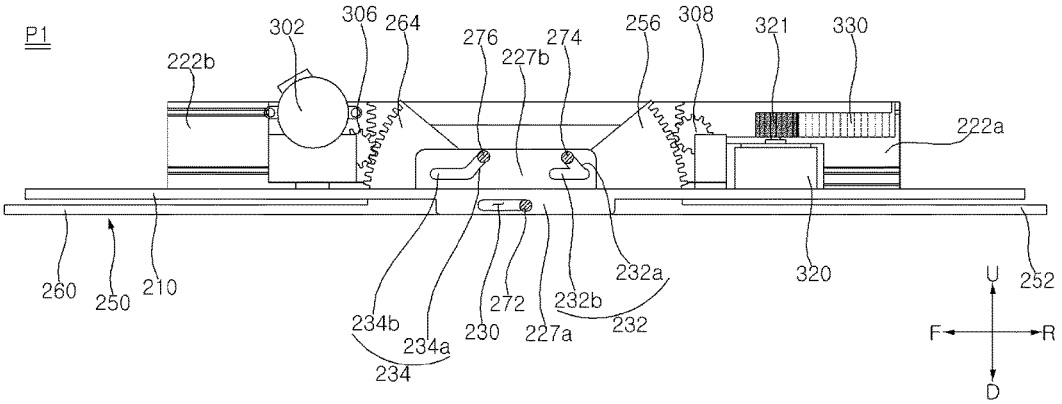
FIG. 34 is a diagram explaining a first position of the variable panel according to the second embodiment of the present disclosure.

As illustrated in FIG. 34, the variable panel 250 may be disposed in the first position P1 in which the variable panel 250 closes the first communication hole 212 and the second communication hole 214. As illustrated in FIG. 35, the variable panel 250 may be disposed in the second position P2 in which the variable panel 250 opens the first communication hole 212 and the second communication hole 214. As illustrated in FIG. 36, the variable panel 250 may be disposed in the third position P3 in which the variable panel 250 moves up and down from the second position P2.

Referring to FIG. 34, in the first position P1, the first variable panel 252 may be disposed at a lower side of the first communication hole 212. In the first position P1, the second variable panel 260 may be disposed at a lower side of the second communication hole 214. The variable panel 250 may have a greater area than the base panel 210. Accordingly, when disposed in the first position P1, the variable panel 250 may cover the entire bottom of the base panel 210. Accordingly, when the variable panel 250 is disposed in the first position P1, components of the base panel 210 may not be exposed to an occupant present in a lower part of an indoor space.

In the first position P1, the first pin 274 may be disposed at an upper end of the first pin hole 232. In the first position P1, the second pin 276 may be disposed at an upper end of the second pin hole 234.

By the operation of the first motor 302, the variable panel 250 may be changed in shape from the first position P1 to the second position P2. When the first motor 302 is activated, the motor gear 304 rotates the first gear 306. When the first gear 306 is rotated, the first panel gear 256 engaged with one side of the first gear 306 moves to change the position of the first variable panel 252. In this case, an inclination angle of the first variable panel 252 may be changed.

In addition, when the first gear 306 is rotated, the first mover 310 engaged with another side of the first gear 306 moves downward. When the first mover 310 moves downward, the second gear 308 engaged with one side of the first mover 310 is rotated thereby. When the second gear 308 is rotated, the second panel gear 264 engaged with one side of the second gear 308 moves to change the position of the second variable panel 260. In this case, an inclination angle of the second variable panel 260 may be changed.

Each of the first variable panel 252 and the second variable panel 260 are rotated about the hinge 270.

When the variable panel 250 is changed from the first position P1 to the second position P2, the hinge 270 may remain in place. When the variable panel 250 is changed from the first position P1 to the second position P2, the third pin 272 may remain in place.

When the variable panel 250 is changed from the first position P1 to the second position P2, the first pin 274 moves downward along the first curved part 232*a* of the first pin hole 232. When the variable panel 250 is changed from the first position P1 to the second position P2, the second pin 276 moves downward along the second curved part 234*a* of the second pin hole 234.

Figure 35:
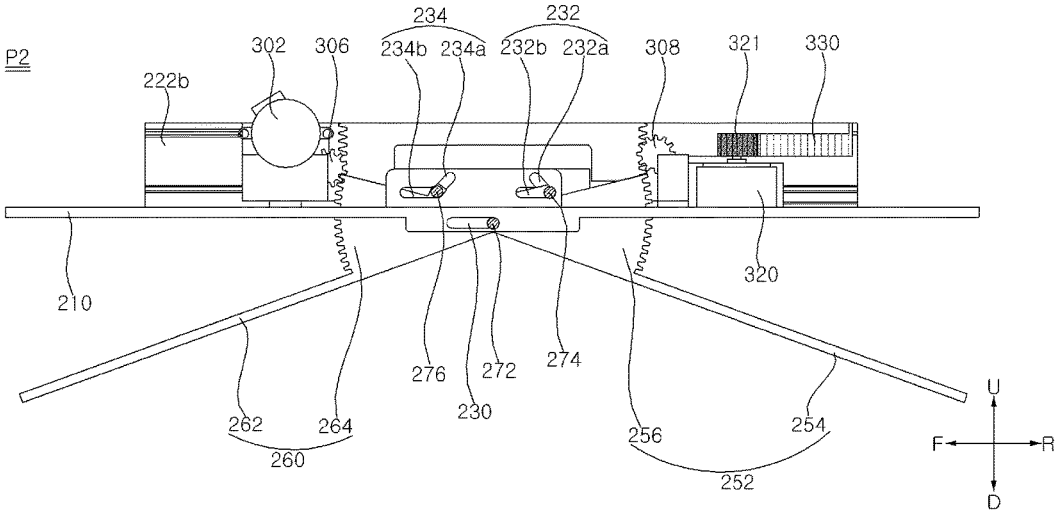
FIG. 35 is a diagram explaining a second position of the variable panel according to the second embodiment of the present disclosure.
Figure 36:
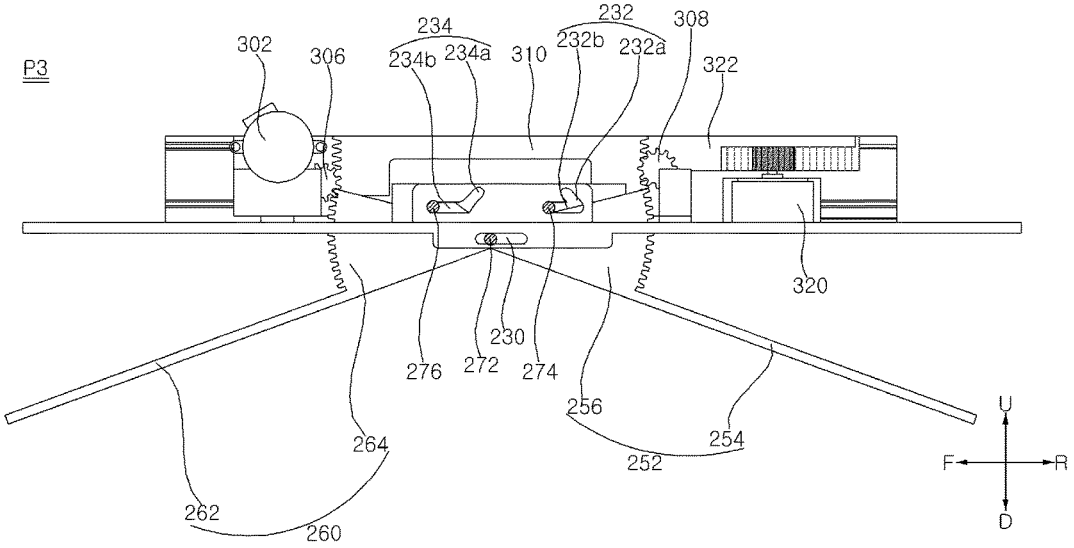
FIG. 36 is a diagram explaining a third position of the variable panel according to the second embodiment of the present disclosure.
Figure 37:
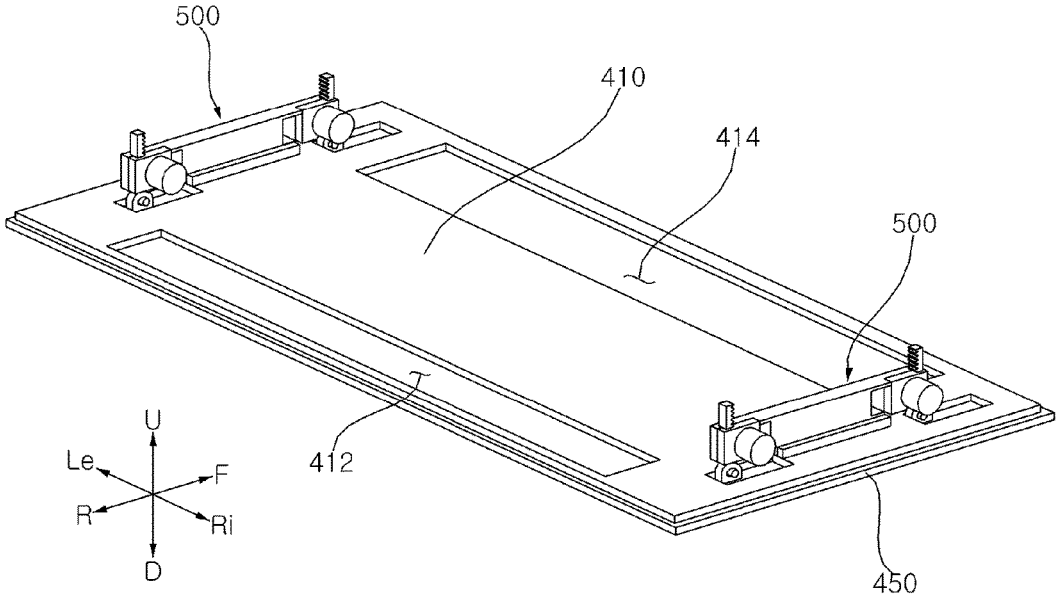
FIG. 37 is a perspective view of a state in which a base panel, a variable panel, and a driving device of an air conditioner are coupled each other according to a third embodiment of the present disclosure.
Figure 38:
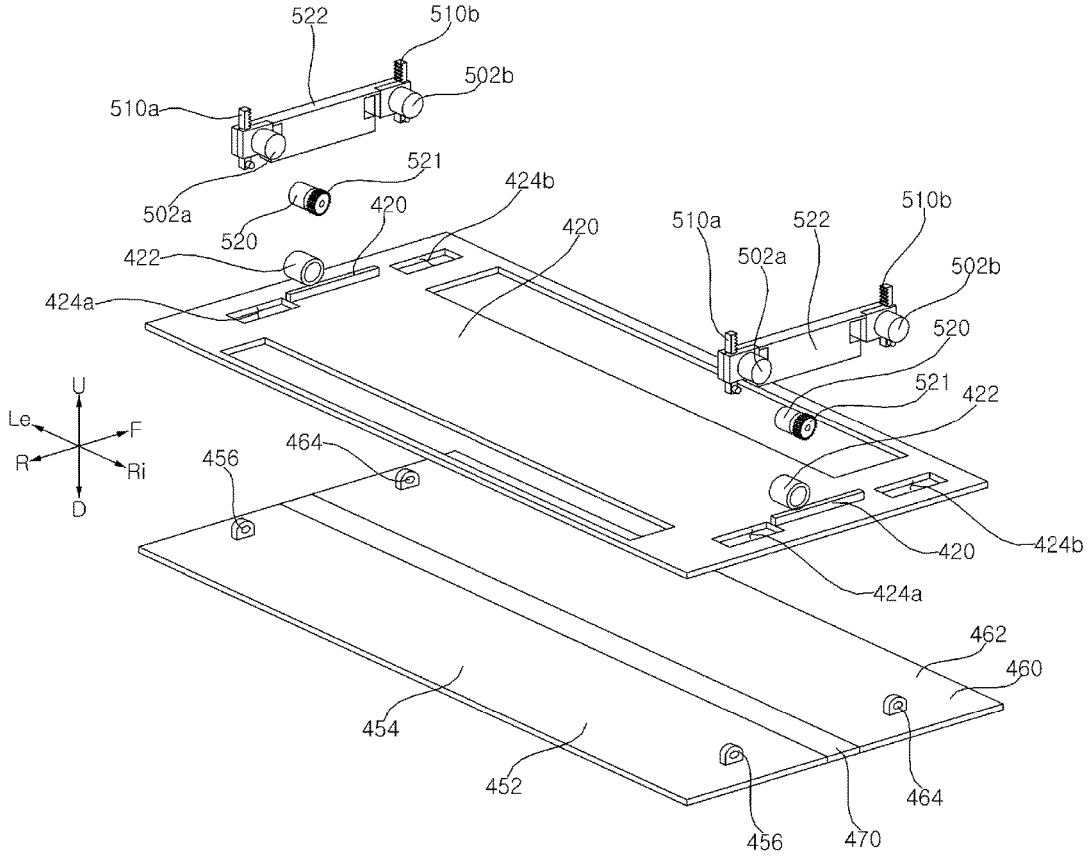
FIG. 38 is an exploded perspective view of the base panel, the variable panel, and the driving device of the air conditioner according to the third embodiment of the present disclosure.

Referring to FIG. 35, in the second position P2, the variable panel 250 may open each of the first communication hole 212 and the second communication hole 214. Accordingly, air may flow through the first communication hole 212 or the second communication hole 214.

In the second position P2, each of the first variable panel 252 and the second variable panel 260 may be inclined with respect to the base panel 210. In the second position P2, the first variable panel 252 and the second variable panel 260 may be inclined in different directions.

In the second position P2, the first pin 274 may be disposed at a lower end of the first curved part 232*a* of the first pin hole 232. In the second position P2, the second pin 276 may be disposed at a lower end of the second curved part 234*a* of the second pin hole 234.

By the operation of the second motor 320, the variable panel 250 may be changed in shape from the second position P2 to the third position P3. When the second motor 320 is activated, the horizontal gear 321 is rotated in engagement with the horizontal rack 330. By the rotation of the horizontal gear 321, the horizontal rack 330 moves forward and backward. By the rotation of the horizontal gear 321, the first mover 310 moves forward and backward. By the movement of the first mover 310, the second mover 322 and the variable panel 250 may move together forward and backward.

Third Embodiment

Hereinafter, a variable panel, a driving device, and a base panel according to the third embodiment will be described with reference to FIGS. 37 to 42.

A variable panel 450 may include a fixed part fixed in position vertically relative to the base panel 210, a cover part spaced apart from the fixed part and disposed at a lower side of the first communication hole 212 or the second communication hole 214, and a variable part disposed between the fixed part and the cover part and changing an inclination angle of the cover part.

The fixed part and the variable part may be a variable part 470 to be described with reference to the third embodiment. The cover part may be a first cover part 452 and a second cover part 460 to be described with reference to the third embodiment.

The variable panel 450 in the third embodiment includes the first cover part 452 disposed under the base panel 410 and changed in position at the lower side of the first communication hole 412, a second cover part 460 disposed under the base panel 410 and changed in position at the lower side of the second communication hole 414, and the variable part 470 changed in shape and disposed between the first cover part 452 and the second cover part 460.

One of the first communication hole 412 and the second communication hole 414 may be an inlet through which outside air is drawn into the air conditioner. The other one of the first communication hole 412 and the second communication hole 414 may be an outlet through which air in the air conditioner is discharged to the outside.

The first cover part 452 may open and close the first communication hole 412. The second cover part 414 may open and close the second communication hole 414. An inclination angle of the first cover part 452 may be changed at the lower side of the first communication hole 412. Here, the inclination angle may refer to an angle between surfaces formed by each of the first cover part 452 and the base panel 410. An inclination angle of the second cover part 460 may be changed at the lower side of the second communication hole 414.

The first cover part 452 includes a first plate 454, and a pair of first connectors 456 connected to a driving device 500 to change arrangement of the first plate 454. The second cover part 460 includes a second plate 462, and a pair of second connectors 464 connected to the driving device 500 to change arrangement of the second plate 462.

The variable part 470 may be made of a deformable material. The variable part may be made of a different material from the cover part. The variable part 470 may be disposed between the first cover part 452 and the second cover part 460.

The variable part 470 may be made of a deformable material. One side of the variable part 470 may be movably connected to the base panel 410. That is, although not illustrated herein, a central portion of the variable part 470 in the front-rear direction may be connected to the base panel 410. Accordingly, the central portion of the variable part 470 may be maintained in contact with the base panel 410.

A first connector 456 has a first connecting hole 456*a* in which a connecting protrusion 512 of first movers 510*a* and 510*b* which will be described below is disposed. The first connecting hole 456*a* may extend from an upper side of the first plate 454 in the front-rear direction. Accordingly, the connecting protrusion 512 of the first movers 510*a* and 510*b*, which is disposed in the first connecting hole 456*a*, may move forward and backward within the first connecting hole 456*a* depending on arrangement. The first connecting hole 456*a* may extend in the front-rear direction further than a diameter of the connecting protrusion 512.

The second connector 464 also has a second connecting hole 464*a* in which the connecting protrusion 512 of the first movers 510*a* and 510*b* which will be described below is disposed. The second connecting hole 464*a* may have the same shape as the first connecting hole 456*a*.

The driving device 500 may include a first driving device for changing a shape of the variable panel 450, and a second driving device for moving a position of the variable panel 450.

The first driving device may be first motors 502*a* and 502*b* and first movers 510*a* and 510*b* which will be described below. The first driving device may include a plurality of gears connected to the first motors 502*a* and 502*b* or the first movers 510*a* and 510*b*.

The second driving device may be a second motor 520 and a second mover 522 which will be described below. The second driving device may include a horizontal gear 521 connected to the second motor 520.

The driving device 500 may be disposed at both ends of the variable panel 450 in the left-right direction. The driving device 500 may be disposed at each of a left portion and a right portion of the variable panel 450. The driving devices 500 disposed at the left portion and the right portion of the variable panel 450 may have the same configuration. Accordingly, the configuration of the driving device 500 which will be described below may be applied to the driving device disposed at each of the left portion and the right portion of the variable panel.

The driving device 500 includes a pair of first motors 502*a* and 502*b* for changing arrangement of the variable panel 450. Each of the pair of first motors 502*a* and 502*b* may change a shape of the variable panel 450.

The driving device 500 includes a pair of first movers 510*a* and 510*b* connected to the pair of first motors 502*a* and 502*b*, respectively, so as to move up and down. The pair of first movers 510*a* and 510*b* may have a shape of a long bar extending in the up-down direction. A gear surface, connected to the pair of first motors 502*a* and 502*b*, may be formed on one side surface of each of the pair of first movers 510*a* and 510*b*.

The connecting protrusion 512, protruding leftward or rightward and connected to the variable panel 450, may be disposed at a lower end of each of the pair of first movers 510*a* and 510*b*. The connecting protrusion 512 may be disposed in a direction perpendicular to a moving direction of the first movers 510*a* and 510*b*. The connecting protrusion 512 may move up and down together with the first movers 510*a* and 510*b*.

The connecting protrusion 512 may be disposed in connecting holes 456*a* and 462*a* of the connectors 456 and 462 disposed on the first cover part 452 or the second cover part 460.

The driving device 500 includes a pair of first gears 506*a* and 506*b* connected to the pair of first motors 502*a* and 502*b*, respectively, to be rotated thereby and engaged with the pair of first movers 510*a* and 510*b*, respectively.

The driving device 500 includes a pair of first motor mounters 504*a* and 504*b* fixing the position of the pair of first motors 502*a* and 502*b*. The pair of first motor mounters 504*a* and 504*b* may be fixed to the base panel 410 or the second mover 522 which will be described below.

Figure 39:
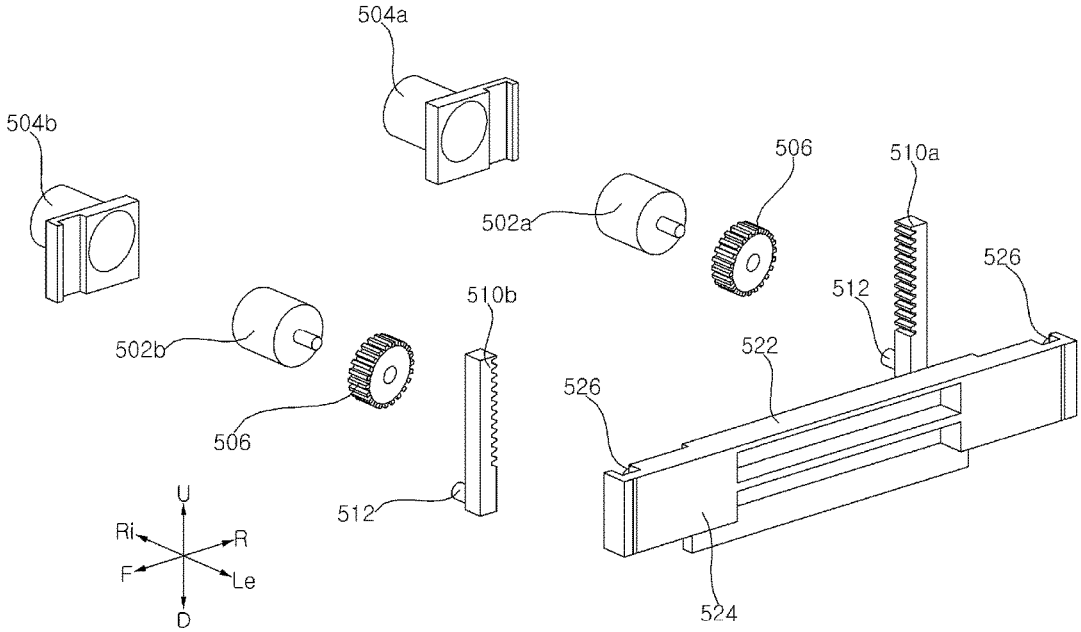
FIG. 39 is an exploded perspective view of the driving device according to the third embodiment of the present disclosure.

Referring to FIG. 39, the first motors 502*a* and 502*b* in this embodiment are fixed to the second mover 522, such that the first motor mounters 504*a* and 504*b* may also be coupled to the second mover 522.

The driving device 500 includes the second mover 522 for moving a position of the variable panel 450, and the second motor 520 for moving the second mover 522. The driving device 500 may include the horizontal gear 521 connected to the second motor 520 to be rotated thereby.

The second mover 522 is movably disposed on the base panel 410. The second mover 522 may move forward and backward on the base panel 410. The second mover 522 includes a moving panel 524 on which the first movers 510*a* and 510*b* are mounted. The pair of first motor mounters 504*a* and 504*b* are mounted on the moving panel 524.

A pair of first guide grooves 526 for guiding up-and-down movement of the pair of first movers 510*a* and 510*b* are formed in the moving panel 524. The first movers 510*a* and 510*b* may be disposed in the first guide grooves 526. The first movers 510*a* and 510*b* may move up and down within the first guide grooves 526.

A horizontal rack (not shown), engaged with the horizontal gear 521 on a surface facing the horizontal gear 521, may be disposed on the moving panel 524. When the horizontal gear 521 is rotated, the horizontal gear 521 is engaged with the horizontal rack to move the second mover 522 forward and backward.

Each of the pair of first motors 502*a* and 502*b* may be rotatably mounted to the second mover 522.

The first communication hole 412 and the second communication hole 414 may be formed in the base panel 410. The first communication hole 412 and the second communication hole 414 may be spaced apart from each other in the front-rear direction.

A guide wall 420 for guiding movement of the second mover 522 may be disposed on the base panel 410. A second motor mounter 422 for fixing a position of the second motor 520 is disposed on the base panel 410. The second motor mounter 422 may fix the position of the second motor 520 disposed on the base panel 410. The second motor mounter 422 may be disposed on one side of the guide wall 420.

Through-holes 424*a* and 242*b*, through which the pair of first movers 510*a* and 510*b* respectively pass, may be formed in the base panel 410. The first movers 510*a* and 510*b* may be formed by passing through the through-holes formed in the base panel 410. Accordingly, upper ends of the first movers 510*a* and 510*b* are disposed at an upper side of the base panel 410, and lower ends thereof may be disposed at a lower side of the base panel 410. The plurality of through-holes 424*a* and 242*b* may be formed in the base panel 410. The respective through-holes 424*a* and 242*b* may be spaced apart from each other in the front-rear direction or in the left-right direction.

Hereinafter, a change of shape and movement of position of the variable panel 450 by the operation of the first motor 302 and the second motor 320 will be described with reference to FIGS. 40 to 42.

Figure 40:
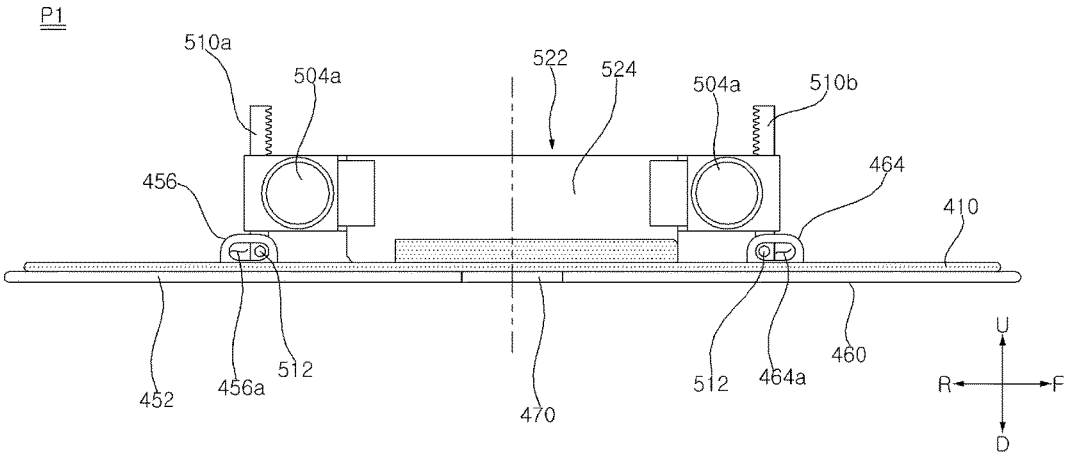
FIG. 40 is a diagram explaining a first position of the variable panel according to the third embodiment of the present disclosure.

As illustrated in FIG. 40, the variable panel 450 may be disposed in the first position P1 in which the variable panel 450 closes the first communication hole 412 and the second communication hole 414. As illustrated in FIG. 41, the variable panel 450 may be disposed in the second position P2 in which the variable panel 450 opens the first communication hole 412 and the second communication hole 414. As illustrated in FIG. 42, the variable panel 450 may be disposed in the third position P3 in which the variable panel 450 moves up and down from the second position P2.

Referring to FIG. 40, in the first position P1, the first cover part 452 is disposed at a lower side of the first communication hole 412. In the first position P1, the second cover part 460 is disposed at a lower side of the second communication hole 414. The variable panel 450 may have a greater area than the base panel 410. Accordingly, in the first position P1, the variable panel 450 may cover the entire bottom of the base panel 410. Accordingly, when the variable panel 450 is disposed in the first position P1, components of the base panel 410 may not be exposed to an occupant present in a lower part of an indoor space.

In the first position P1, each of the connecting holes 456*a* and 462*a* of the connectors 456 and 462 may be disposed above the base panel 410. In the first position P1, the lower ends of the first movers 510*a* and 510*b* may be disposed at an upper side of the base panel 410. In the first position P1, the connecting protrusion 512 of the first movers 510*a* and 510*b* may be in close contact with the inside of the connecting holes 456*a* and 462*a* in a direction in which the variable part 470 is disposed.

By the operation of the first motors 502*a* and 502*b*, the variable panel 450 may be changed in shape from the first position P1 to the second position P2. When each of the pair of first motors 502*a* and 502*b* is activated, the pair of first motors 502*a* and 502*b* rotate the pair of first gears 506*a* and 506*b*, respectively. When each of the pair of first gears 506*a* and 506*b* is rotated, each of the pair of first movers 510*a* and 510*b* moves downward.

Accordingly, by the operation of the pair of first motors 502*a* and 502*b*, the pair of first movers 510*a* and 510*b* move downward, such that an inclination angle of the first plate 454 and the second plate 462 may be changed.

When the variable panel 450 is changed from the first position P1 to the second position P2, the variable part 470 may be changed in shape to a bent shape. When the variable panel 450 is changed from the first position P1 to the second position P2, the connecting protrusion 512 disposed at a lower end of each of the pair of first movers 510*a* and 510*b* moves to a lower side of the base panel 410. As the connecting protrusion 512 moves to the lower side, an inclination angle of each of the first cover part 452 and the second cover part 460 may be changed. Here, the inclination angle may be an angle formed between the first cover part 452 or the second cover part 460 and the base panel 410.

When the variable panel 450 is changed from the first position P1 to the second position P2, the connecting protrusion 512 disposed in the connecting holes 456*a* and 462*a* may be changed in relative position within the connecting holes 456*a* and 462*a*. The connecting protrusion 512 moves up and down, but the connecting holes 456*a* and 462*a* move circumferentially, such that a relative position of the connecting protrusion 512 may be changed.

Figure 41:
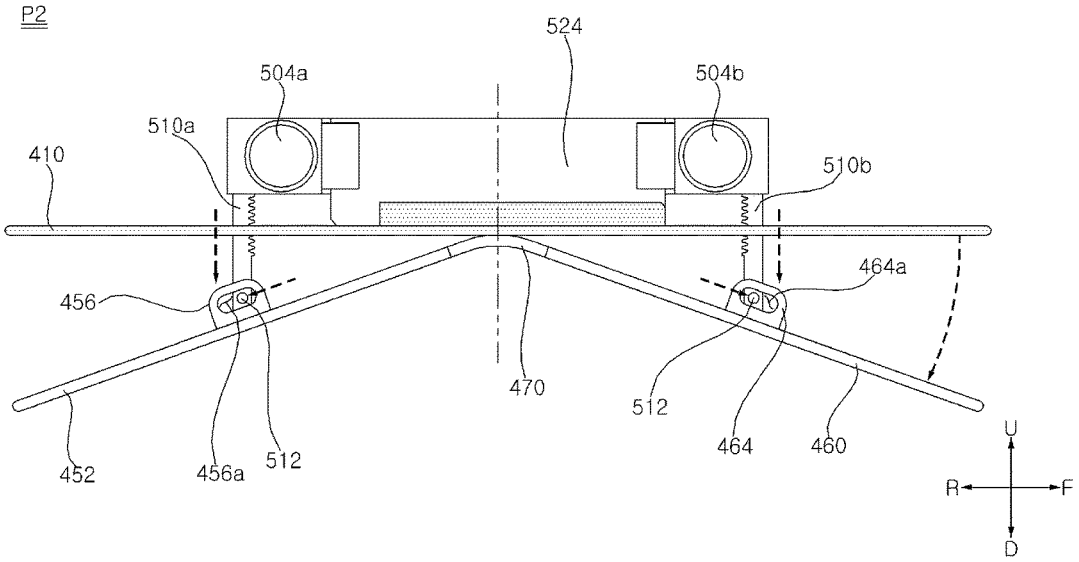
FIG. 41 is a diagram explaining a second position of the variable panel according to the third embodiment of the present disclosure.
Figure 42:
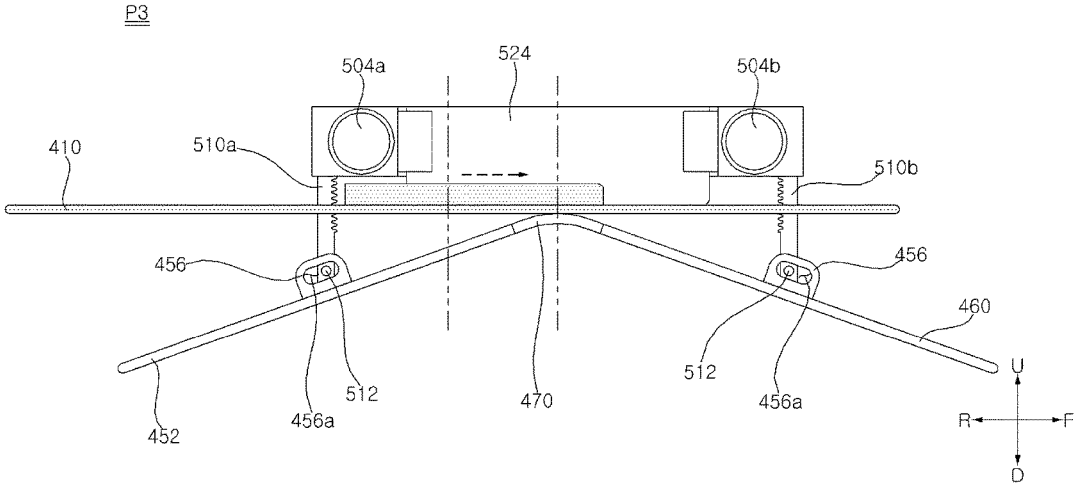
FIG. 42 is a diagram explaining a third position of the variable panel according to the third embodiment of the present disclosure.

Referring to FIG. 41, when disposed in the second position P2, the variable panel 450 may open each of the first communication hole 412 and the second communication hole 414. Accordingly, air may flow through the first communication hole 412 or the second communication hole 414.

In the second position P2, each of the first cover part 452 and the second cover part 260 may be inclined with respect to the base panel 410. In the second position P2, each of the first cover part 452 and the second cover part 260 may be inclined in different directions.

In the second position P2, lower ends of the pair of first movers 510*a* and 510*b* may be disposed under the base panel 410.

By the operation of the second motor 520, the variable panel 450 may be changed from the second position P2 to the third position P3. When the second motor 520 is activated, the horizontal gear 521 is rotated in engagement with the horizontal rack. By the rotation of the horizontal gear 521, the horizontal rack moves forward and backward. By the rotation of the horizontal gear 521, the first movers 510*a* and 510*b* move forward and backward. By the movement of the first movers 510*a* and 510*b*, the second mover 522 and the variable panel 450 may move together forward and backward.

While the preferred embodiments have been particularly shown and described, the present specification shall not be limited to the particular embodiments described above, and it will be understood by an ordinary skilled person in the art that various changes in form and details may be made therein without departing from the spirit and scope of the present invention as defined by the following claims, and the alternative embodiments should not be individually understood from the inventive concept and prospect of the present disclosure.

What is claimed is:

1. An air conditioner, comprising:

a base panel having a first communication hole formed in a first side thereof, and a second communication hole formed in a second side thereof;

a variable panel disposed under the base panel and changed in shape to open and close the first communication hole and the second communication hole; and a driving unit that is disposed on an upper side of the base panel and changes a position of one side of the variable panel in an up-down direction, so that the variable panel is changed in shape, wherein the first communication hole and the second communication hole are spaced apart from each other in a forward and backward direction, wherein the variable panel is mounted on the base panel so as to be movable in the forward and backward direction, and wherein the driving unit comprises:

a first driving unit configured to change a shape of the variable panel; and a second driving unit configured to move a position of the variable panel in the forward-backward direction.

2. The air conditioner of claim 1, wherein the variable panel comprises a cover part disposed at a lower side of the first communication hole or the second communication hole, and a variable part that changes an inclination angle of the cover part.

3. The air conditioner of claim 1, wherein the driving unit comprises a first motor fixed to the base panel, and configured to change the shape of the variable panel or to move the position of the variable panel.

4. The air conditioner of claim 3, wherein the variable panel comprises a fixed part disposed between the first communication hole and the second communication hole and fixed in position vertically relative to the base panel, and a cover part disposed on one side of the fixed part and changed in position vertically relative to the base panel, and wherein the first motor is configured to change an inclination angle of the cover part or to move a position of the cover part.

5. The air conditioner of claim 3, wherein the variable panel comprises a first plate disposed at a lower side of the first communication hole, and a second plate disposed at a lower side of the second communication hole, wherein the driving unit comprises a second motor configured to change an inclination angle of the second plate, and wherein the first motor is configured to change an inclination angle of the first plate or to move a position of the first plate.

6. The air conditioner of claim 5, wherein the driving unit comprises:

a first gear connected to the first motor to be rotated thereby;

a second gear connected to the second motor to be rotated thereby;

a first panel moving plate connected to the first plate and changing an inclination angle of the first plate by the rotation of the first gear; and a second panel moving plate connected to the second plate and changing an inclination angle of the second plate by the rotation of the second gear.

7. The air conditioner of claim 6, wherein the driving unit further comprises a spacer that maintains a distance between the first panel moving plate and the second panel moving plate.

8. The air conditioner of claim 6, wherein a panel guider, that guides movement of each of a first panel guide and a second panel guide, is disposed on the base panel.

9. The air conditioner of claim 8, wherein:

a first guide pin, extending around a first rotary shaft of the first panel moving plate, is disposed on the first panel moving plate;

a second guide pin, extending around a second rotary shaft of the second panel moving plate, is disposed on the second panel moving plate; and a first guide hole and a second guide hole are formed in the panel guider, wherein the first guide hole guides movement of the first guide pin, and the second guide hole guides movement of the second guide pin.

10. The air conditioner of claim 9, wherein a third guide pin is disposed on the first panel moving plate, wherein the third guide pin is radially spaced apart from the first rotary shaft and extends parallel to the first rotary shaft of the first panel moving plate, and wherein a third guide hole, that guides movement of the third guide pin, is formed in the panel guider.

11. The air conditioner of claim 10, wherein the third guide hole comprises a curved guide hole that extends circumferentially from a position spaced apart from the first rotary shaft by a predetermined distance, and a linear guide hole that extends from a lower end of the curved guide hole in a direction parallel to the first guide hole.

12. The air conditioner of claim 9, wherein:

the first panel moving plate rotates about the first rotary shaft;

a gear surface engaged with the first gear is formed on one side surface of the first panel moving plate, wherein the gear surface comprises a first gear surface formed in a circumferential direction, and a second gear surface that is connected to one end of the gear surface and extends in a radial direction.

13. The air conditioner of claim 12, wherein the first gear surface and the second gear surface are continuously engaged with the first gear.

14. The air conditioner of claim 9, wherein a gear surface is formed on the second panel moving plate, wherein the gear surface is radially spaced apart from the second rotary shaft and engaged with the second gear on an outer circumferential surface extending in a circumferential direction, and wherein a stopper is disposed on an upper surface of the second panel moving plate, the stopper limiting downward movement of the second panel moving plate.

15. The air conditioner of claim 5, further comprising a moving panel disposed under the base panel to be movable forward and backward, and coupled to the variable panel, wherein the first motor is fixed to one side of the base panel, and the second motor is fixed to an upper side of the moving panel.

16. The air conditioner of claim 1, wherein the first communication hole and the second communication hole may be opened and closed simultaneously or together by the variable panel.

17. An air conditioner, comprising:

a base panel having a first communication hole formed in a first side thereof, and a second communication hole formed in a second side thereof;

a variable panel disposed under the base panel and changed in shape to open and close the first communication hole and the second communication hole; and a driving unit that is disposed on an upper side of the base panel and changes a position of one side of the variable panel in an up-down direction, so that the variable panel is changed in shape, wherein the variable panel comprises:

a first plate disposed under the base panel so as to open and close the first communication hole, and a first variable panel comprising a first panel gear connected to the driving unit to change a position of the first plate; and a second plate disposed under the base panel so as to open and close the second communication hole, and a second variable panel comprising a second panel gear connected to the driving unit to change a position of the second plate, wherein the first communication hole and the second communication hole are spaced apart from each other in a forward and backward direction, and wherein the driving unit comprises:

a first motor;

a first mover coupled to the first motor so as to move up and down;

a first gear that is coupled to the first mover and changes a position of the first panel gear;

a second gear that is coupled to the first mover and changes a position of the second panel gear;

a second mover that moves the position of the variable panel in the forward and backward direction; and a second motor that is disposed on the base panel and moves the second mover.

18. The air conditioner of claim 17, wherein the driving unit further comprises a motor gear connected to a rotary shaft of the first motor, and wherein the first gear is rotated in engagement with the motor gear, and the first gear is engaged with each of the first mover and the first panel gear.

19. The air conditioner of claim 18, wherein the first gear comprises a first inner gear engaged with each of the motor gear and the first mover, and a first outer gear engaged with the first panel gear, and wherein the first inner gear and the first outer gear are rotated together about a same rotational axis.

20. The air conditioner of claim 17, wherein the first mover comprises a first vertical bar having a first gear surface engaged with the first gear, a second vertical bar spaced apart from the first vertical bar and having a second gear surface engaged with the second gear, and a horizontal bar connecting the first vertical bar and the second vertical bar.

21. An air conditioner, comprising:

a base panel having a first communication hole formed in a first side thereof, and a second communication hole formed in a second side thereof;

a variable panel disposed under the base panel and changed in shape to open and close the first communication hole and the second communication hole; and a driving unit that is disposed on an upper side of the base panel and changes a position of one side of the variable panel in an up-down direction, so that the variable panel is changed in shape, wherein the driving unit comprises a motor fixed to the base panel, and a gear rotated by the motor, wherein a panel moving plate, on which a gear surface engaged with the gear is formed, is disposed on the variable panel, wherein the gear surface is formed to change a shape of the variable panel or to move a position of the variable panel, when the motor is activated, wherein the gear surface, engaged with a motor rotary shaft coupled to the motor, is formed on an inner surface of the panel moving plate, and wherein the gear surface includes a first gear surface that extends in a circumferential direction about the motor rotary shaft, and a second gear surface that extends in a radial direction with respect to the motor rotary shaft.

* * * * *